US009759057B2

(12) United States Patent
Morin et al.

(10) Patent No.: US 9,759,057 B2
(45) Date of Patent: Sep. 12, 2017

(54) APPARATUS, SYSTEM AND METHOD FOR SEPARATING SAND AND OTHER SOLIDS FROM OIL AND OTHER FLUIDS

(71) Applicant: DYNACORP FABRICATORS INC., Calgary (CA)

(72) Inventors: Justin Morin, Calgary (CA); Rory Nagge, Calgary (CA)

(73) Assignee: DYNACORP FABRICATORS INC., Calgary, Alberta (CA)

( * ) Notice: Subject to any disclaimer, the term of this patent is extended or adjusted under 35 U.S.C. 154(b) by 319 days.

(21) Appl. No.: 14/588,261

(22) Filed: Dec. 31, 2014

(65) Prior Publication Data

US 2015/0292313 A1 Oct. 15, 2015

Related U.S. Application Data

(60) Provisional application No. 61/978,363, filed on Apr. 11, 2014.

(51) Int. Cl.
*E21B 43/34* (2006.01)

(52) U.S. Cl.
CPC ..... *E21B 43/34* (2013.01)

(58) Field of Classification Search
None
See application file for complete search history.

(56) References Cited

U.S. PATENT DOCUMENTS 2,218,533 A * 10/1940 Huebotter ..... E21B 21/065 175/217
2,713,919 A * 7/1955 Walker ..... C10G 33/06 210/123
2,922,750 A * 1/1960 Price ..... C10G 33/06 196/14.5
3,222,881 A * 12/1965 Moon ..... B01D 9/0013 62/196.1
3,228,174 A * 1/1966 Perry, Jr. ..... B01D 19/0052 55/484
3,290,935 A * 12/1966 McCarter ..... E21B 43/34 73/200
3,450,632 A * 6/1969 Huval ..... B01D 17/045 210/318
4,101,172 A 7/1978 Rabbitts
4,255,269 A * 3/1981 Timmer ..... B01D 33/0346 175/206

(Continued)

FOREIGN PATENT DOCUMENTS

| | | |
|---|---|---|
| CN | 2403893 | 11/2000 |
| WO | 2005115583 | 12/2005 |
| WO | 2011014055 | 2/2011 |

OTHER PUBLICATIONS

Derry D. Sparlin, Sr., "Selecting Type of Sand Control for Horizontal Wells", World Oil online, vol. 226, No. 8, Aug. 2005, http://www.worldoil.com/August-2005-Sand-control-in-horizontal-wells.html, retrieved Sep. 16, 2013, pp. 1-5.

*Primary Examiner* — Shane Bomar

(74) *Attorney, Agent, or Firm* — MH2 Technology Law Group, LLP

(57) ABSTRACT

An apparatus comprising one or more screens which in use eliminates sand and/or fluid slugs from blocking at a screen by placing at least the screen in an elevated secondary chamber, configured to prevent sand, fluid slugs and the like from accumulating around the screen.

16 Claims, 26 Drawing Sheets

(56) References Cited

U.S. PATENT DOCUMENTS

| | | | |
|---|---|---|---|
| 4,694,901 | A | 9/1987 | Skinner |
| 5,216,788 | A | 6/1993 | Bock |
| 5,355,948 | A | 10/1994 | Sparlin et al. |
| 5,450,898 | A | 9/1995 | Sparlin et al. |
| 6,189,617 | B1 | 2/2001 | Sorhus et al. |
| 6,196,319 | B1 | 3/2001 | Henskens et al. |
| 7,380,595 | B2 | 6/2008 | Wetzel et al. |
| 8,127,847 | B2 | 3/2012 | Richard et al. |
| 2008/0217002 | A1 | 9/2008 | Simonds et al. |
| 2011/0303543 | A1 | 12/2011 | Fritze |
| 2013/0032352 | A1 | 2/2013 | Raglin |
| 2013/0134108 | A1 | 5/2013 | Howard |
| 2013/0233786 | A1 | 9/2013 | Posa |

* cited by examiner

| | | | |
|---|---|---|---|
| Required: | Qv = | Flow rate of gas @ maximum inlet velocity & a controlled velocity assuming 100%/80%/60%/40%/20%/0% effectiveness of the screen | |
| Given: | P = | 14.7 psia | atmospheric pressure |
| | Pinlet = | 1000-5000 | gauge pressure @ inlet (in 1000psi increments) |
| | Pd = | 10 psi | pressure drop |
| | Pia = | P + Pinlet | absolute pressure @ inlet |
| | d1 = | 2" | ID of pipe @ inlet |
| | d2 = | 11" | ID of vessel |
| | $\gamma$ = | 0.053813 lb/ft³ | Specific Weight @ Atm. Pressure @273K |

Assuming: Expansion of gas from inlet to vessel is isothermal & isentropic

1) Calculating maximum possible inlet velocity @ MAWP $$V_1 = \sqrt{\frac{2(p_{ia} - p_d)}{p_1}}$$

Where: $\rho 1$ = the density of gas @ inlet pressure (5000psi)

$$p_1 = \frac{\gamma_1}{g} = \frac{\gamma\left({P_{1a}}/{P}\right)}{g}$$

Using inlet pressure of 5000psi $$p_1 = \frac{\left(0.053813\ \frac{lb}{ft^3}\right)\left(\frac{5014.7}{14.7}\right)}{32.174\ {ft}/{s^2}}$$

$$p_1 = 0.570571097\ \frac{lb*s^2}{ft*ft^3} = 0.570571097\ Slugs/ft^3$$

$$V_1 = \sqrt{\frac{2(5014.7 - 10)\text{psia}}{0.570571097\ \frac{Slugs}{ft^3}}}$$

$$V_1 = 132.4491386\ \frac{ft}{s}$$

Figure 19A

Calculate the Flow Through the Vessel From 1000-5000psi (not adjusted for density of gas)

2) Flow Through Vessel & Velocity Inside Vessel @ 5000psi $Q_a = V_{1a}A_1$ $Q_a = 132.4491386\,\frac{ft}{s} * (\pi/4)(2/12)^{2ft^2}$ $Q_a = 2.88959195\,\frac{ft^3}{s}$ $V_{2a} = Q_a/A_{2a}$ $$V_{2a} = \frac{2.88959195\,\frac{ft^3}{s}}{(\pi/4)(11/12)^2}$$

$V_{2a} = 4.378483921\ ft/s$

3) Volumetric Flow of Gas (Volume calculated at Atm. Pressure & 273K)

$$Q_{va} = Q_a * \left( {}^{P_{ia}}/_{P} \right)$$

$Q_{va} = 2.88959195\,\frac{ft^3}{s} * \frac{5014.7}{14.7}$ $$Q_{va} = 985.7439968\ \frac{ft^3}{s} * \left( \frac{3600\frac{s}{hour} * 24\frac{hour}{day}}{1000000} \right)$$

$Q$va = 85.16828132 MMSCF/D @ 100% Screen Effectiveness $Q$va = 68.13462506MMSCF/D @ 80% Screen Effectiveness $Q$va = 51.10096879 MMSCF/D @ 60% Screen Effectiveness $Q$va = 34.06731253 MMSCF/D @ 40% Screen Effectiveness $Q$va = 17.03365626 MMSCF/D @ 20% Screen Effectiveness $Q$va = 0 MMSCF/D @ 0% Screen Effectiveness

Figure 19B

Required: Qf = Flow rate of fluid @ maximum inlet velocity & a controlled velocity assuming 100%/80%/60%/40%/20%/0% effectiveness of the screen

| | | | |
|---|---|---|---|
| Given: | P1 = | 5000 psi | inlet pressure |
| | P2 = | 4600 psi | pressure in the outlet spool |
| | γ = | 62.4 lb/ft³ | specific weight of water |
| | v = | 7.37 x 10^(-6) ft²/s | kinematic viscosity of water |
| | d = | 2" | ID of pipe at inlet |

Assuming: No change in potential energy in the fluid as it travels through the vessel 4) Calculate maximum velocity of 100% water/frac sand solution 4.1) Calculate flow rates $$V_1 = \sqrt{\frac{2Pd}{\rho_1}} = \sqrt{\frac{2(P_1 - P_2)}{\gamma/g}} = velocity\ at\ inlet$$

Figure 19C $$V_1 = \sqrt{\frac{2(5000-4600)psi}{62.4\frac{lb}{ft^3} \Big/ 32.174\frac{ft}{s^2}}}$$

$$V_1 = 20.30978039\ ft/s$$

$$Q_1 = V_1 A_1$$

$$Q_1 = 20.30978039\frac{ft}{s} * \left(\frac{\pi}{4}\left({}^{2}/_{12}\right)^2\right) ft^2$$

$$Q_1 = 0.443090672\ ft^3/s$$

$$V_2 = {}^{Q_1}/_{A_2} = velocity\ in\ vessel$$

$$V_2 = \frac{0.443090672\ ft^3/s}{\left(\frac{\pi}{4}\left({}^{11}/_{12}\right)^2\right) ft^2}$$

$$V_2 = 0.671397697\ ft/s$$

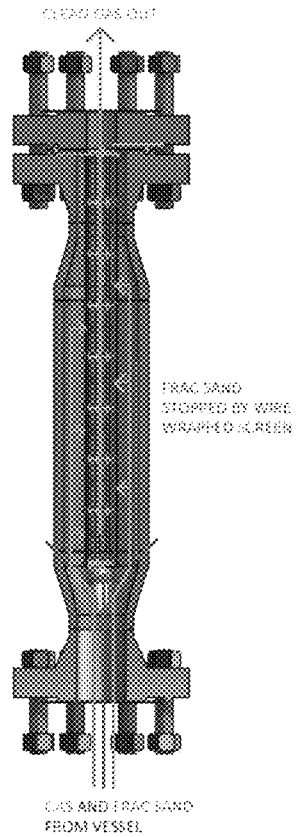

4.2) Calculate flow across screen given:
- 4" NPS Pipe, 4.57" OD
- 0.01 slot size
- 0.140" x 0.297" wrap
- screen length; L = 60"

$$Open\ Area\ (\%) = \frac{0.01}{0.14+0.01} * 100\% = 6.6\%$$

$$Open\ Area\ (in^2/ft) = (\pi \cdot OD_{screen}) * 12\frac{in}{ft}(Open\ Area\ (\%))$$

$$Open\ Area = (\pi * 4.57in) * 12\frac{in}{ft} * \frac{6.6}{100}$$

$$Open\ Area = 11.48566273\ in^2/ft$$

Figure 19D 4.3) Flow cap across screen $$Flow\ Cap = \frac{Open\ Area\ \left({in^2}/{ft}\right)}{\left(\left(\frac{231\frac{in^3}{gallon}}{12\frac{in}{ft}}\right) \Big/ \left(V_{across\ screen}\frac{ft}{s}\right)\left(60\frac{s}{min}\right)\right)}$$

a) Using assumed velocity across screen of 0.1 ft/s $$Flow\ Cap = \frac{11.48566273\ \left({in^2}/{ft}\right)}{\left(\left(\frac{231\frac{in^3}{gallon}}{12\frac{in}{ft}}\right) \Big/ \left(V_{across\ screen}\frac{ft}{s}\right)\left(60\frac{s}{min}\right)\right)}$$

$$Flow\ Cap = 3.579946825\ \frac{gallon}{ft * min}$$

Figure 19E

$$Q_a = Flow\ Cap\left(\frac{gallon}{ft * min}\right) * 231\frac{in^3}{gallon} * \left(0.0254\frac{m}{ln}\right)^3 * 60\frac{min}{hour} * 24\frac{hour}{day} * \pi * OD_{screen} * \left(\frac{L}{\left(12\frac{in}{ft}\right)^2}\right)$$

$$Q_a = 3.579946825\left(\frac{gallon}{ft * min}\right) * 231\frac{in^3}{gallon} * \left(0.0254\frac{m}{ln}\right)^3 * 60\frac{min}{hour} * 24\frac{hour}{day} * \pi * 4.57in * \left(\frac{60in}{\left(12\frac{in}{ft}\right)^2}\right)$$

$$Q_a = 116.7365969\left(\frac{m^3}{day}\right)$$

b) Using maximum inlet velocity of 100% fluid/frac sand solution $$Flow\ Cap = \frac{11.48566273\left(in^2/ft\right)}{\left(\left(\frac{231\frac{in^3}{gallon}}{12\frac{in}{ft}}\right) \Big/ \left(0.671397697\frac{ft}{s}\right)\left(60\frac{s}{min}\right)\right)}$$

$$Flow\ Cap = 24.03568054\frac{gallon}{ft * min}$$

Figure 19F

$$Q_b = Flow\ Cap\left(\frac{gallon}{ft * min}\right) * 231\frac{in^3}{gallon} * \left(0.0254\frac{m}{ln}\right)^3 * 60\frac{min}{hour} * 24\frac{hour}{day} * \pi * OD_{screen} * \left(\frac{L}{\left(12\frac{in}{ft}\right)^2}\right)$$

$$Q_b = 24.03568054\left(\frac{gallon}{ft * min}\right) * 231\frac{in^3}{gallon} * \left(0.0254\frac{m}{ln}\right)^3 * 60\frac{min}{hour} * 24\frac{hour}{day} * \pi * 4.57in * \left(\frac{60in}{\left(12\frac{in}{ft}\right)^2}\right)$$

$$Q_b = 783.365969\left(\frac{m^3}{day}\right)$$

c) Using controlled velocity of 40 ft/s at inlet $$Flow\ Cap = \frac{11.48566273\ \left(in^2/ft\right)}{\left(\left(\frac{231\frac{in^3}{gallon}}{12\frac{in}{ft}}\right) \Big/ \left(1.32231405\frac{ft}{s}\right)\left(60\frac{s}{min}\right)\right)}$$

Figure 19G

$$Flow\ Cap = 47.33813985\ \frac{gallon}{ft * min}$$

$$Q_c = Flow\ Cap\left(\frac{gallon}{ft * min}\right) * 231\frac{in^3}{gallon} * \left(0.0254\frac{m}{ln}\right)^3 * 60\frac{min}{hour} * 24\frac{hour}{day} * \pi * OD_{screen} * \left(\frac{L}{\left(12\frac{in}{ft}\right)^2}\right)$$

$$Q_c = 47.33813985\left(\frac{gallon}{ft * min}\right) * 231\frac{in^3}{gallon} * \left(0.0254\frac{m}{ln}\right)^3 * 60\frac{min}{hour} * 24\frac{hour}{day} * \pi * 4.57in * \left(\frac{60in}{\left(12\frac{in}{ft}\right)^2}\right)$$

$$Q_c = 1543.624423\left(\frac{m^3}{day}\right)$$

Using results from c):

Find flow rate through screen at 0%/20%/40%/60%/80%/100% of the screens effective area, flow is the same for all inlet pressures $Q_c = 1543.624423\ m^3/day\ \ at\ 100\%\ screen\ effectiveness$ $Q_c = 1234.899538\ m^3/day\ \ at\ 80\%\ screen\ effectiveness$ $Q_c = 926.1746538\ m^3/day\ \ at\ 60\%\ screen\ effectiveness$ $Q_c = 617.4497692\ m^3/day\ \ at\ 40\%\ screen\ effectiveness$ $Q_c = 308.7248846\ m^3/day\ \ at\ 20\%\ screen\ effectiveness$ $Q_c = 0.0\ m^3/day\ \ at\ 0\%\ screen\ effectiveness$

Figure 19H

APPARATUS, SYSTEM AND METHOD FOR SEPARATING SAND AND OTHER SOLIDS FROM OIL AND OTHER FLUIDS

TECHNICAL FIELD

This invention relates generally to the field of sand filters and methods of separating fracturing sand from the desired hydrocarbons from wells.

BACKGROUND

Gas resources such as shale are accessed using a process called hydraulic fracturing. Fracturing, or "fracking," process begins with the drilling of a well into a rock formation This technique further involves injecting a mixture of water, sand and a small amount of other additives (blend of chemicals) into a well. These fluids typically consist of about 90 percent water and 9.5 percent sand. Many of the ingredients in the remaining 0.5 percent of the mixture have common consumer applications in household products, detergents and cosmetics. These chemicals are used to reduce friction, prevent bacteria growth and protect the rock formation, making the hydraulic fracturing safer and more efficient.

The pressurized hydraulic fluid acts as a propping agent or proppant and creates hairline cracks in the shale and these cracks, held open by the sand particles, allow the gas to flow up through the wellbore to the surface. So, fracture sand is commonly introduced into the reservoir in an effort to create "conductive channels" from the reservoir rock into the wellbore, thereby allowing the hydrocarbons a much easier flow path into the tubing and up to the surface of the well.

Hydraulic fracturing is not new. It was first used in conventional oil and gas extraction in the late 1940s in North America. Since then, more than one million wells around the world have been drilled using hydraulic fracturing. In Alberta, it has been used for more than 60 years to safely and reliably fracture over 167,000 wells. What is new, however, is the use of multiple technologies in conjunction with one another to make accessing unconventional gas more feasible. By combining hydraulic fracturing with horizontal drilling, operators can safely produce affordable, reliable quantities of natural gas from shale and other unconventional sources.

The well equipment which is used to produce oil from a well typically includes components that are designed to separate the unwanted substances from the oil. For instance, a sand separator is commonly provided at the surface of the well to remove the sand that may be present as a result of fracking.

Conventional sand separation systems primarily rely on gravity to separate the sand from the fluids that are produced from a well. Typically, fluid is introduced into the central portion of a large, vertically oriented chamber through a pipe that is referred to as a stinger. The fluid flows slowly upward, typically through one or more baffles, to an outlet at the top of the chamber. The chamber has a large diameter so that the linear speed of the fluid flowing through the chamber will be minimized. This allows the sand to settle out of the fluid and fall to the bottom of the chamber, where it can be accumulated and removed.

There are various problems with the use of conventional sand separators to remove sand from oil or other fluids. For example, as noted above, the chamber of the apparatus needs to be large in order to minimize the speed of the fluid so that the sand can settle out. The large size of the apparatus can make it difficult to transport and install. Additionally, because of material cost, the sheer size of apparatus makes it more expensive.

Another problem is that it is difficult to accommodate the different operating conditions and fluid characteristics that may exist in different wells. For instance, one well may have a higher flow rate than another, so the settling of the sand out of the faster-flowing fluid may be less effective. Likewise, higher viscosity or lower temperature of the fluid may reduce settling in a conventional sand separator. Addressing these problems may require that an entirely different sand separator be used.

Overall, natural or manmade particulates can cause a multitude of producing problems for oil and gas operators. For example, in flowing wells abrasive particulates can "wash through" metals in piping creating leaks and potentially hazardous conditions. Particulates can also fill-up and stop-up surface flow lines, vessels, and tanks. In reservoirs whereby some type of artificial lift is required such as rod pumping, electric submersible pumps, progressive cavity, and other methods, production of particulates can reduce of the life of the down-hole assembly and increase maintenance cost.

It is an object of the present invention to obviate or mitigate the above disadvantages.

SUMMARY

It is an object of the present invention to provide an apparatus, system and method for separating sand and other solids from oil and other fluids that may be produced from a well, wherein this apparatus, system and method solve one or more of the problems discussed above.

It is an object of the present invention to provide an apparatus comprising one or more screens which is use eliminates sand and/or fluid slugs from blocking at a screen by placing at least the screen in an elevated secondary chamber, configured to prevent sand, fluid slugs and the like from accumulating around the screen.

It is an object of the present invention to provide an apparatus comprising one or more screens which eliminates sand carryover. Current used apparatus allow sand to carryover through the system, wherein system fills with sand and/or fluid slugs and wherein sand is therein carried past the sand catcher.

It is an object of the present invention to provide an apparatus, system and method wherein the combined principles of "velocity knockout", at a first step of processing and selective screening, at second and third steps (wherein such screening at a second step provides filtration of sand particles within specific particle size), reduces the restriction of fluid flow caused by screen blockage.

It is an object of the present invention to provide an apparatus, system and method which reduces and/or eliminates screen damage with a hydrate breaker between at least a first step of processing and a third step of processing.

It is an object of the present invention to provide an apparatus, system and method which eliminates exposure of operators to process fluids/particulates/other by-products ("waste") during a hydraulic fracking, flowback and related production whereby a blowdown process uses well pressure to transfer waste to a storage vessel, either via a manual or an automated trigger.

The present disclosure specifically provides a series of method/process steps (an alternative systems and apparatus for use therewith) for separating sand and other solids from oil and/or other fluids therein generating cleaned fluids.

Applications for use are across a wide variety of industries, such industries not being limited to the oil and gas industry, mining, pulp and paper, semiconductor, food and beverage, chemical plating, as well as municipal waste water treatment, electric power generation, environmental remediation, and the generation of clean water for human, animal and agricultural uses.

The present invention provides a sand filtering apparatus for separating solids from a fluid comprising:

a) a horizontally disposed gravity knock-out tube;

b) an inlet at a first end of the tube for introducing untreated fluid; said tube being of a size and configuration such that, in operation, gravitational force on particles of the solid substantially exceeds any drag created by flow of said fluid, thereby to induce gravity settling of at least a portion of the solid at a bottom of the tube ("settled solids"), said settled solids, in situ, serving to increased differential pressure from the inlet to an outlet;

c) the outlet, disposed at a second end of the tube, opposing the first end and in fluid communication with at least one of i) a vertically oriented tubular screen chamber and ii) a horizontally oriented tubular screen chamber, wherein vertically oriented tubular screen chamber and horizontally oriented tubular screen chamber (together, the "tubular screen chambers") are elevated relative to the horizontally disposed gravity knock-out tube to prevent/reduce solids from accumulating around the tubular screen chambers;

d) perforated plate for secondary filtering disposed between outlet and vertically oriented tubular screen chamber or horizontally oriented tubular screen chamber, said perforated plate wherein vertically oriented tubular screen chamber and horizontally oriented tubular screen chamber comprise a wire wrapped slotted screen configured to filter out fine particulates and wherein wire wrapped slotted screen is housed within a removable cartridge.

The present invention further provides a method for separating sand or other solids from oil or other fluids that are produced from a well, the method comprising:

a) introducing a fluid containing solids into a horizontally disposed gravity knock-out tube, wherein the fluid is introduced into the horizontally disposed gravity knock-out tube rate and direction such that a gravitational force on particles of the solid substantially exceeds any drag created by flow of said fluid, thereby to induce gravity settling of at least a portion of the solid at a bottom of the tube ("settled solids"), said settled solids, in situ, serving to increased differential pressure from the inlet to an outlet and therein forming a primary treated fluid; and b) passing said primary treated fluid to a vertically oriented tubular screen chamber via a perforated plate, wherein vertically oriented tubular screen chamber is elevated relative to the horizontally disposed gravity knock-out tube to prevent/reduce solids from accumulating around the vertically orientated tubular screen chamber, wherein vertically oriented tubular screen chamber comprises a wire wrapped slotted screen configured to filter out fine particulates and wherein wire wrapped slotted screen is housed within a removable cartridge.

The present invention further provides a method for separating sand or other solids from oil or other fluids that are produced from a well, the method comprising:

a) introducing a fluid containing solids into a horizontally disposed gravity knock-out tube, wherein the fluid is introduced into the horizontally disposed gravity knock-out tube rate and direction such that a gravitational force on particles of the solid substantially exceeds any drag created by flow of said fluid, thereby to induce gravity settling of at least a portion of the solid at a bottom of the tube ("settled solids"), said settled solids, in situ, serving to increased differential pressure from the inlet to an outlet and therein forming a primary treated fluid; and b) passing said primary treated fluid to a horizontally oriented tubular screen chamber oriented tubular screen chamber via a perforated plate, wherein horizontally oriented tubular screen chamber is elevated relative to the horizontally disposed gravity knock-out tube to prevent/reduce solids from accumulating around the horizontally orientated tubular screen chamber, wherein horizontally oriented tubular screen chamber comprises a wire wrapped slotted screen configured to filter out fine particulates and wherein wire wrapped slotted screen is housed within a removable cartridge.

Using the method, apparatus and system of the invention, there is a reduction in the frequency for on-site personnel at a well site as well as a savings of thousands of dollars per day on worksites. Furthermore the method, apparatus and system of the invention reduces the frequency of Vac-Truck trips to clean out the filters or remove other waste by-products. This can lead to tens of thousands in savings per month for each well.

These and other advantages will become apparent throughout this specification.

BRIEF DESCRIPTION OF THE DRAWINGS

FIG. 13 is a perspective view of step 3—showing vertically oriented tubular screen chamber and horizontally oriented tubular screen chamber comprise a wire wrapped slotted screen configured to filter out fine particulates and wherein wire wrapped slotted screen is housed within a removable cartridge wherein FIG. 13 illustrates removable cartridge in place;

FIG. 14 is a perspective view of step 3—showing vertically oriented tubular screen chamber and horizontally oriented tubular screen chamber comprise a wire wrapped slotted screen configured to filter out fine particulates and wherein wire wrapped slotted screen is housed within a removable cartridge, wherein FIG. 14 illustrates removable cartridge with screen removed;

FIGS. 19A, 19B, 19C, 19D, 19E, 19F, 19G and 19H provide an example of flow rate calculations.

Figure 1:
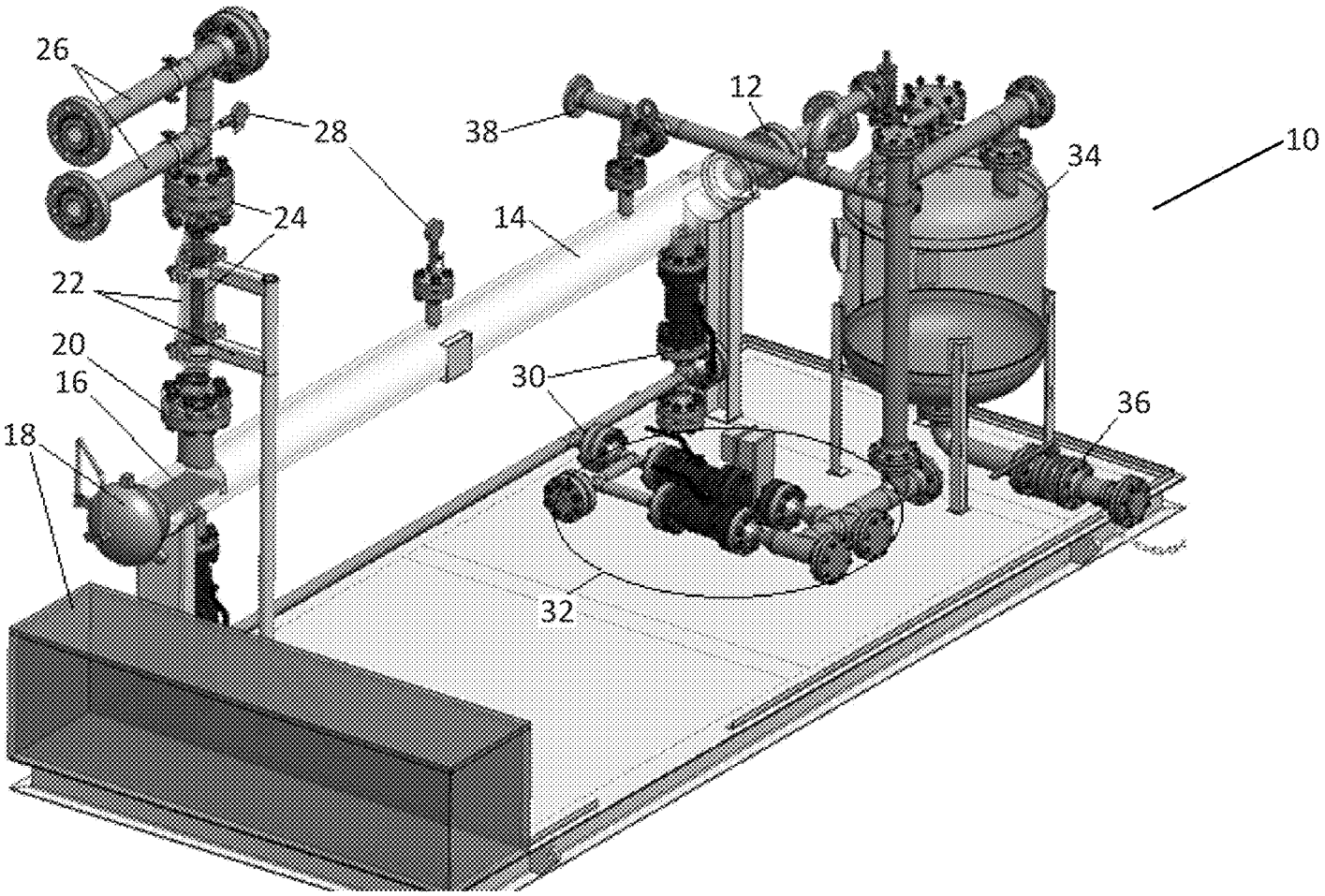
FIG. 1 is a perspective view of a horizontal/vertical sand filter apparatus.

The figures depict embodiments of the present invention for purposes of illustration only. One skilled in the art will readily recognize from the following description that alternative embodiments of the structures and methods illustrated herein may be employed without departing from the principles of the invention described herein.

DETAILED DESCRIPTION OF THE PREFERRED EMBODIMENTS

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I. Terms

The term "product" means any machine, manufacture and/or composition of matter, unless expressly specified otherwise.

The term "method" means any process, method or the like, (and vice versa) unless expressly specified otherwise.

Each process (whether called a method or otherwise) inherently includes one or more steps, and therefore all references to a "step" or "steps" of a process have an inherent antecedent basis in the mere recitation of the term "process" or a like term. Accordingly, any reference in a claim to a "step" or "steps" of a process has sufficient antecedent basis.

The term "invention" and the like mean "the one or more inventions disclosed in this application," unless expressly specified otherwise.

The terms "an aspect", "an embodiment", "embodiment", "embodiments", "the embodiment", "the embodiments", "one or more embodiments", "some embodiments", "certain embodiments", "one embodiment", "another embodiment" and the like mean "one or more (but not all) embodiments of the disclosed invention(s)", unless expressly specified otherwise. The term "variation" of an invention means an embodiment of the invention, unless expressly specified otherwise.

A reference to "another embodiment" or "another aspect" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "plurality" means "two or more", unless expressly specified otherwise.

The term "herein" means "in the present application, including anything which may be incorporated by reference", unless expressly specified otherwise.

The phrase "at least one of", when such phrase modifies a plurality of things (such as an enumerated list of things) means any combination of one or more of those things, unless expressly specified otherwise. For example, the phrase "at least one of a widget, a car and a wheel" means either (i) a widget, (ii) a car, (iii) a wheel, (iv) a widget and a car, (v) a widget and a wheel, (vi) a car and a wheel, or (vii) a widget, a car and a wheel. The phrase "at least one of", when such phrase modifies a plurality of things does not mean "one of" each of the plurality of things.

It should be noted that several of the terms used in this disclosure are preceded by the descriptors "generally" or "substantially". These descriptors are used to indicate that a term which is preceded by one of these descriptors is intended to be construed broadly. For instance, a cylinder is a well-defined mathematical construct and it does not technically encompass conic sections. Because the separation chamber described above may be cylindrical, or may have a slightly tapered wall, the chamber is described as "generally cylindrical". Similarly, the fluid flow through the separation chamber is described as "generally circular", which should be construed to include helical and conical (helical with a decreasing diameter) flow paths. This interpretation of the terms used herein will be easily understood by a person of ordinary skill in the art of the invention.

While the foregoing disclosure primarily discusses apparatus, systems and methods for removing sand from oil, (and specifically in the fracking process) it is to be understood they can be more broadly applied to the removal of other solids from various types of fluids. Consequently, as used above, "sand" should be construed to both sand and other types of solids that might be found in fluids produced from a well. Similarly, "fluids" should be construed to include oil, water, gas, and other fluids that might be produced from a well.

As used herein, the term "frac sand" is sand used as a proppant to keep underground fractures or fissures (created through the process of hydraulic fracturing) propped open. Proppant sand can be natural sand or it can be resin coated—but usually only the naturally occurring (uncoated) type is called frac sand.

As used herein, the term "fracking" or hydraulic fracturing, is the process of using a high pressure fluids to create fissures in relatively impermeable rock (formations in which the pores that contain hydrocarbons are not very well interconnected) to enable gas or oil to flow out of the well. Chemicals are pumped into the ground as a result of fracking, and it is often necessary to drill through drinking water aquifers.

As used herein, the term "hydraulic fracturing" is the process of using high pressure fluids to create fractures in a very tight formation that otherwise would not let hydrocarbons to freely pass into a well. The fractures increase the permeability of the formation As used herein, the term "hydrocarbon" is a chemical compound comprised of only carbon and hydrogen. The fuels such as a natural gas and oil that energy producers take out of the ground are often referred to as hydrocarbons. Gas and oil, as taken out of the ground, are each actually comprised of a mixture of different types of hydrocarbons, plus impurities. Hydrocarbons generally can be burned to produce heat.

Numerical terms such as "one", "two", etc. when used as cardinal numbers to indicate quantity of something (e.g., one widget, two widgets), mean the quantity indicated by that numerical term, but do not mean at least the quantity indicated by that numerical term. For example, the phrase "one widget" does not mean "at least one widget", and therefore the phrase "one widget" does not cover, e.g., two widgets.

The phrase "based on" does not mean "based only on", unless expressly specified otherwise. In other words, the phrase "based on" describes both "based only on" and "based at least on". The phrase "based at least on" is equivalent to the phrase "based at least in part on".

The term "represent" and like terms are not exclusive, unless expressly specified otherwise. For example, the term "represents" do not mean "represents only", unless expressly specified otherwise. In other words, the phrase "the data represents a credit card number" describes both "the data represents only a credit card number" and "the data represents a credit card number and the data also represents something else."

The term "whereby" is used herein only to precede a clause or other set of words that express only the intended result, objective or consequence of something that is previously and explicitly recited. Thus, when the term "whereby" is used in a claim, the clause or other words that the term "whereby" modifies do not establish specific further limitations of the claim or otherwise restricts the meaning or scope of the claim.

The term "e.g." and like terms mean "for example", and thus does not limit the term or phrase it explains. For example, in a sentence "the computer sends data (e.g., instructions, a data structure) over the Internet", the term "e.g." explains that "instructions" are an example of "data" that the computer may send over the Internet, and also explains that "a data structure" is an example of "data" that the computer may send over the Internet. However, both "instructions" and "a data structure" are merely examples of "data," and other things besides "instructions" and "a data structure" can be "data."

The term "respective" and like terms mean "taken individually." Thus if two or more things have "respective" characteristics, then each such thing has its own characteristic, and these characteristics can be different from each other but need not be. For example, the phrase "each of two machines has a respective function" means that the first such machine has a function and the second such machine has a function as well. The function of the first machine may or may not be the same as the function of the second machine.

The term "i.e." and like terms mean "that is," and thus limits the term or phrase it explains. For example, in the sentence "the computer sends data (i.e., instructions) over the Internet", the term "i.e." explains that "instructions" are the "data" that the computer sends over the Internet.

Any given numerical range shall include whole and fractions of numbers within the range. For example, the range "1 to 10" shall be interpreted to specifically include whole numbers between 1 and 10 (e.g., 1, 2, 3, 4, . . . 9) and non-whole numbers (e.g. 1.1, 1.2, . . . 1.9).

Where two or more terms or phrases are synonymous (e.g., because of an explicit statement that the terms or phrases are synonymous), instances of one such term/phrase does not mean instances of another such term/phrase must have a different meaning. For example, where a statement renders the meaning of "including" to be synonymous with "including but not limited to", the mere usage of the phrase "including but not limited to" does not mean that the term "including" means something other than "including but not limited to."

Neither the Title (set forth at the beginning of the first page of the present application) nor the Abstract (set forth at the end of the present application) is to be taken as limiting in any way as the scope of the disclosed invention(s). An Abstract has been included in this application merely because an Abstract of not more than 150 words is required under 37 C.F.R. §1.72(b). The title of the present application and headings of sections provided in the present application are for convenience only, and are not to be taken as limiting the disclosure in any way.

Numerous embodiments are described in the present application, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural and logical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

No embodiment of method steps or product elements described in the present application constitutes the invention claimed herein, or is essential to the invention claimed herein, or is coextensive with the invention claimed herein, except where it is either expressly stated to be so in this specification or expressly recited in a claim.

II Overview

The present invention provides an apparatus, system and method for separating sand and other solids from oil and other fluids that may be produced from a well, wherein this apparatus, system and method solve one or more of the problems discussed above.

The apparatus, system and method breaks down the sand filtering into three stages or steps of processing 1) gravity knock-out processing in horizontally disposed gravity knock-out tube; 2) tubular screen chamber filtering, wherein tubular screen chamber (whether horizontal or vertical) is elevated relative to the horizontally disposed gravity knock-out tube to prevent/reduce solids from accumulating around the tubular screen chambers; and 3) secondary filtering through a perforated plate (disposed between outlet and tubular screen chamber).

It is important to understand the mechanisms used to remove liquids and solids from gases. These can be divided generally into four different categories.

Gravity Separation

The first and easiest to understand is gravity settling, which occurs when the weight of droplets or particles (i.e. the gravitation force) exceeds drag created by the flowing gas. In a gravity separator or knock-out drum, gravitational forces control such separation. The lower the gas velocity and the larger the vessel size, the more efficient the liquid/gas separation. Due to the large vessel size required to achieve settling, gravity separators are rarely designed to remove droplets smaller than 300 microns.

Inertial Impaction

Another separation mechanism is called inertial impaction which occurs when a gas passes through a network, such as fibers and impingement barriers. In this case, the gas stream follows a tortuous path around these obstacles while the solid or liquid droplets tend to go in straighter paths, impacting these obstacles. Once this occurs, the droplet or particle loses velocity and/or coalesces, and eventually falls to the bottom of the vessel or remains trapped in the fiber medium.

The mesh wire separator and the vane type separator are well known. The wire mesh separator comprises wire knitted into a pad having a number of unaligned isometrical openings. The principal operation of a wire mesh pad is change of direction. A gas flowing through a pad if forced to change direction a number of times

III Details

As described further herein, and depicted in the figures appended hereto, where the product flowing into the well bore contains sand and other particles, those particles can enter the pump and plug or cause damage to the pump mechanism, as well as the casing and tubing and above ground lines and tanks Where there is sand and other particles mixed into the product, as can occur naturally or through fracking, it would be helpful to have a mechanism for separating the sand and particulates from the hydrocarbon product.

The present invention provides mechanisms for separating particulate matter from the well product.

Turning now to the figures, which illustrate exemplary aspects of the invention and wherein like numerals refer to like components:

Dual H-V Sand Filter Design

As described herein, the sand filter of the invention provides an in-line method of separating the formation and fracturing sand from the desired hydrocarbons being harvested from wells. The sand filters operation is basic and only deals with some supervision to no supervision depending on the amount of automation added to the system. Depending on the well, cleaning out the sand filter is a significant part to keep the sand filter running efficiently. An integral part of the filtration process of this sand filter is the specialized and especially configured positions of the screen(s) in combination with the initial velocity drop out (step one). This step can be seen well in FIGS. 1-3.

Sand Filter Design

There are multiple different designs and methods of operations to separation of all 3 phases (Gas, Liquids, and Sand) of material coming out of the well. The three stages of this design comprise of the initial step, the secondary step, and the final or coalescing step. These steps can be understood with reference to the apparatus of FIGS. 1-4.

Initial Section (Stage 1)

Figure 5:
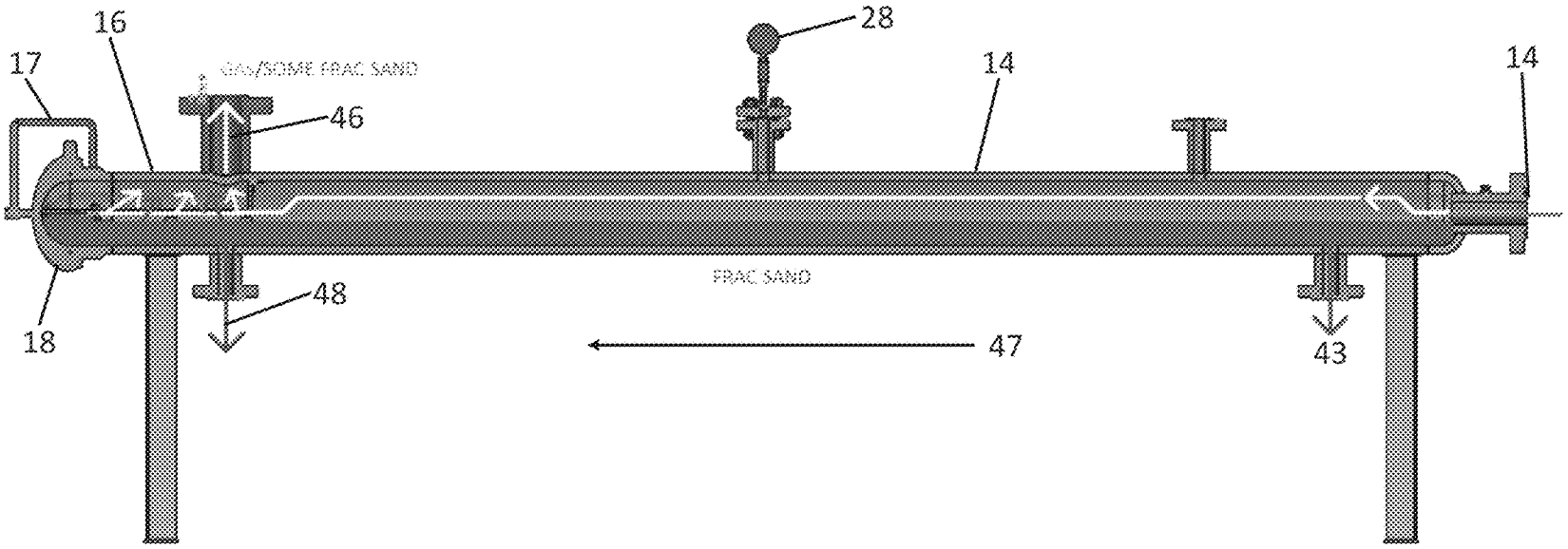
FIG. 5 is a side plan view of the area in which the initial section or step one is performed.

Referral to FIG. 5: Due to the length of the shell, the heavier contaminates have time to settle out from the flow liquids and gas. The large gas to liquid area ratio allows for higher gas velocities letting the liquid and solids move slower. These contaminates will build on the vessel floor and will eventually create differential pressures from the inlet nozzle to the outlet nozzle.

Secondary Section (Stage 2)

As the fluid/sand settles on the bottom of the filter, in the secondary section gas and minimal amounts of sand/fluid flows through a perforated plate. This helps to reduce the amount of sand/fluid being pulled into the next section. It also prevents any particulates large enough to damage the screen from entering the coalescing section.

Coalescing Section (Stage 3)

Figure 6:
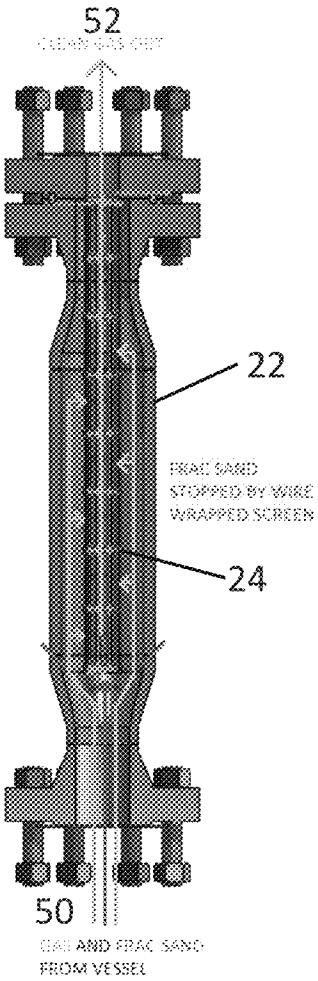
FIG. 6 is a side view of a vertical screen/wire-wrapped slotted screen and gas flow diagram.

Referral to FIG. 6—In the coalescing section attached to a filter main vessel is the final stage of scrubbing the gas from sand and liquids. This part of the vessel houses a wire wrapped slotted screen that filters out all fine particulates and sand that the gas carries up through the outlet nozzle of the vessel and takes the clean gas downstream to further purification and processing plant. Since the particulates are too large for the screen they will be pulled back down to the main section of the filter where it can be cleaned out. The piping system after the screen will indicate the downstream pressure of the gas flow.

Dual H-H Sand Filter Design

Sand Filter Overview

In a preferred aspect, sand filters are an in-line method of separating the formation and fracturing sand from the desired hydrocarbons being harvested from wells. The sand filters operation is basic and only deals with some supervision to no supervision depending on the amount of automation added to the system. Depending on the well, cleaning out the sand filter is a significant part to keep the sand filter running efficiently. The main area of failure and the integral part of the filtration process of this sand filter is the specialized & especially positions screen in combination with the Initial Velocity drop out section.

Sand Filter Design

There are multiple different designs and methods of operations to separation of all three phases (Gas, Liquids, and Sand) of material coming out of the well. The three stages of this design consist of the initial section, the secondary section, and the coalescing section.

Initial Section (Stage 1)

Due to the length of the shell, the heavier contaminates have time to settle out from the flow liquids and gas. The large gas to liquid area ratio allows for higher gas velocities letting the liquid and solids move slower. These contaminates will build on the vessel floor and will eventually create differential Pressures from the inlet nozzle to the outlet nozzle.

Secondary Section (Stage 2)

As the fluid/sand settles on the bottom of the filter, in secondary section the gas and minimal amounts of sand/fluid flows through a perforated plate. This helps to reduce the amount of sand/fluid being pulled into the next section. It also prevents any particulates large enough to damage the screen from entering the coalescing section.

Coalescing Section (Stage 3)

In the coalescing section attached to a filter main vessel is the final stage of scrubbing the gas from sand and liquids. This part of the vessel houses a wire wrapped slotted screen that filters out all fine particulates and sand that the gas carries up through the outlet nozzle of the vessel and takes the clean gas downstream to further purification and processing plant. Since the particulates are too large for the screen they will be pulled back down to the main section of the filter where it can be cleaned out. The piping system after the screen will indicate the downstream pressure of the gas flow.

Slotted Screen, Internal Structure & Cartridge

The screen is able to filter out the last of the heavy contaminates out of the gas and fluid flow. Since the screen is in a vertical position and hung in the centre of the housing, any heavy contaminates that settle on to the screen will be pulled back down into the main area of the vessel reducing the chance of clogging the screen. The cartridge which the screen is housed within, gives appropriate volume for the gas and liquids to pass and filter through the screen. The screen OD and the volume of which the screen is housed in will affect the flow and volume the screen is able to take.

Screens are the most fragile aspect of the whole filter design, as well as being of greatest concern due to it being the primary failure mode of a given unit. There are a number of parameters that need to be considered for filter design:

Abrasion resistance

Crushing resistance (local bending moments due to differential normal force)

Total slot area and orientation

More allows for greater flow rate of gas

Less means greater crushing resistance

Corrosion resistance is not a large issue on a screen if screen material is appropriately selected. Preferably, screen is stainless steel, more preferably, 304L stainless steel. The inner slotted pipe on the screen will corrode eventually which will decrease the screens strength overtime. If the screen does fail, the cartridge can be removed and put back into place without affecting any upstream or downstream piping. This reduces the amount of downtime to replace the screen.

The screen is design as a slotted pipe wrapped with a V shape wire. The V shape wire is the true area of filtration. The spacing between the wire slot size and the size of wire used are able to create different areas that are able to filter different sizes of particulates.

The slotted screen has been designed to support the wire wrap from collapsing. An additional internal cross member is inserted inside the pipe to prevent the screens from crushing due to differential pressure (this was a common problem on previous designs). The slotted design of the screen is able to ensure that there are a set of ribs preferably spaced every 6" apart. This ensures that if the screen is going to collapse that the ribs will give extra reinforcement areas along the screen instead of the straights completely supporting the screen. Each slot has a preferred 45° chamfer to help increase area of each slot without losing strength in each straight. The straights still have some area that is not chamfered so there are no sharp areas and support is given. Screens can either be thread in with a specialty thread to ensure no leaking or can be welded to the hub or blind flange it will be sitting in. The screens slotted areas are calculated into the amount of open area the screen has. The larger the slots the weaker the screen will be, the smaller the slots the stronger the screen will be. If the screen does collapse or the screen wire wrap becomes filled with fine particles and needs to be replaced, the cartridge that houses the screen can be easily removed and put back into operations. Each screen can be either threaded or welded into a double sided hub flange that is bolted between the cartridge and the downstream piping system. In a most preferred form, the Screen and hub flange weigh roughly 85 pounds which makes it easy for an operator to interchange screens with a minor amount of down time.

Sand Filter Clean Out

Monitoring the pressures in the vessel and downstream of the unit, an operator will be able to tell that the vessel will require clean out preventive of pressure differential failure. Once the two pressures hit a certain differential pressure dictated by the recommend screen collapsible pressure design the operator will shut down flow in and out of the unit trapping pressure inside. The operator would then open the drain ball valves blowing out all sand and water to a choke. The choke line relieves pressure and blows all fluids and contaminates into a Blowdown Vessel. This vessel will hold the contaminants until a blowout trucker can come by to clean it out. Once the Sand Filter has blown out all frac sand and other contaminates, the operator shuts the drain ball valves and can re-open upstream and downstream valves to continue processing gas. This is a quick and effective clean out processes to effectively clean out vessels with minimal down time.

An automated system could be easily subbed in more most of the operator's job for this method of clean out. Whether wired back into a SCADA box or done with pneumatic systems, all the ball valves within this service can be hooked up so that it can perform the operator's duties when the differential pressure is reached to automatically clean out the sand filter.

If the sand filter is dealing with large contaminates, or there is not enough pressure to blow out the sand from the vessel, the operator can open the hammer union hatch at the end of the vessel to manually clean out the vessel with a plastic scrapper tool. This can take more time than blowing out the sand filter but can be more effective when the frac sand is a heavy or larger grade of material.

FIG. 1 depicts generally at 10 a horizontal-vertical (H-V) sand filter combination apparatus. In this H-V embodiment, an inlet is shown at 12, pressure vessel/velocity slowdown chamber at 14, hydrate-knock-out baffle at 16, sand clean-out access at 18, and nozzle/transition point from primary to secondary screening stages at 20. Pressure vessel for third stage of processing/cartridge is depicted at 22 comprising wire wrapped screen 24. Outlet or back flush is provided at 26. A downstream pressure indicator for auto/manual dump indication is provided at 28 and PSV line at 38.

In regards to blowdown, blowdown spooling is provided at 30, blowdown valve and by-pass at 32, blowdown vessel at 34 and blowdown drain/clean out at 36.

Figure 2:
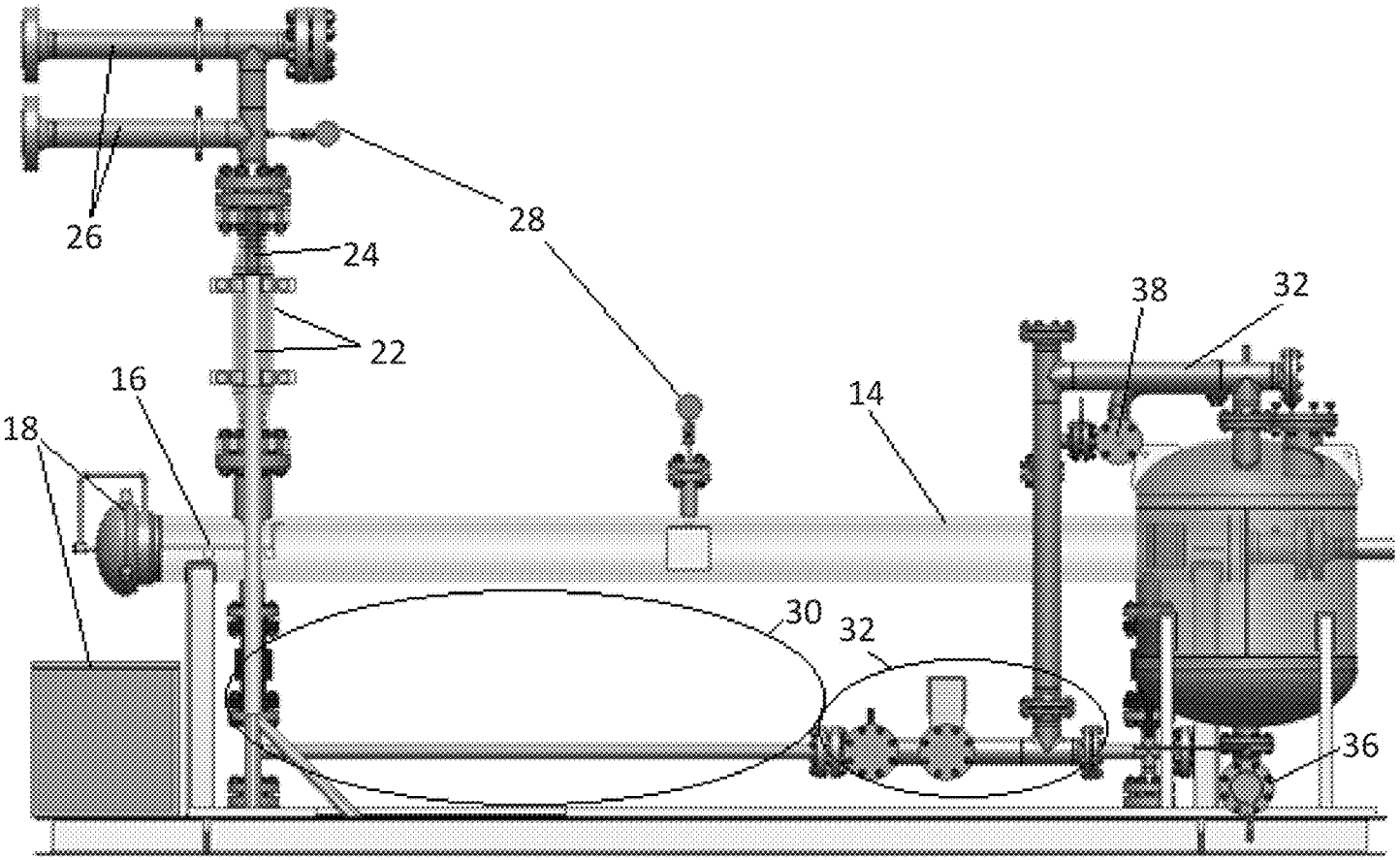
FIG. 2 is a side plan view of a horizontal/vertical sand filter apparatus.

FIG. 2 likewise shows a side plan view of elements 14-18, 22-32, 36, and 38.

Figure 3:
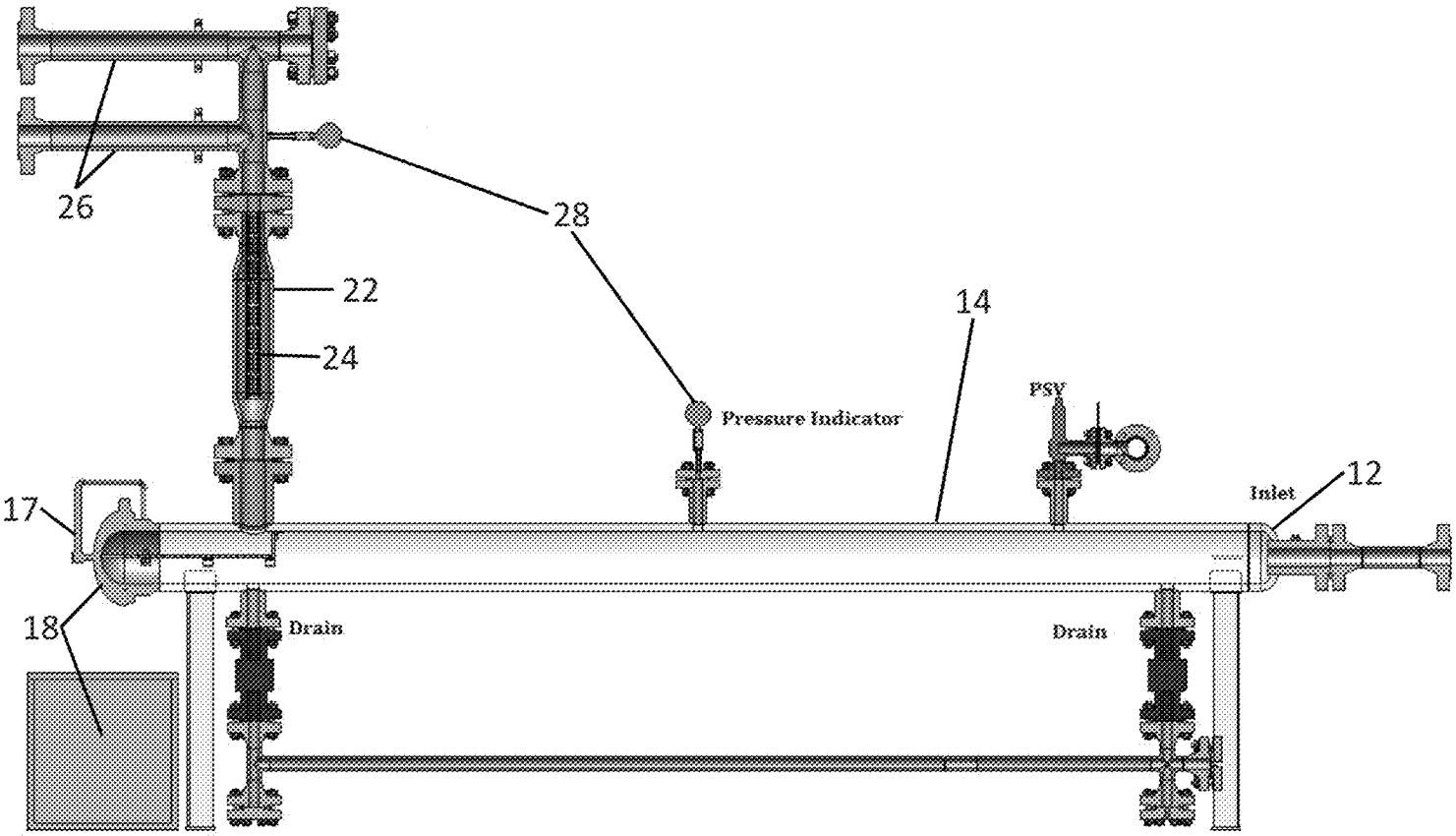
FIG. 3 is a side view of horizontal/vertical sand filter apparatus.

FIG. 3 likewise shows a side plan view of elements including 12, 14 18, 22, 24, 26 and 28. Additionally, hammer closure 17 is shown.

Figure 4:
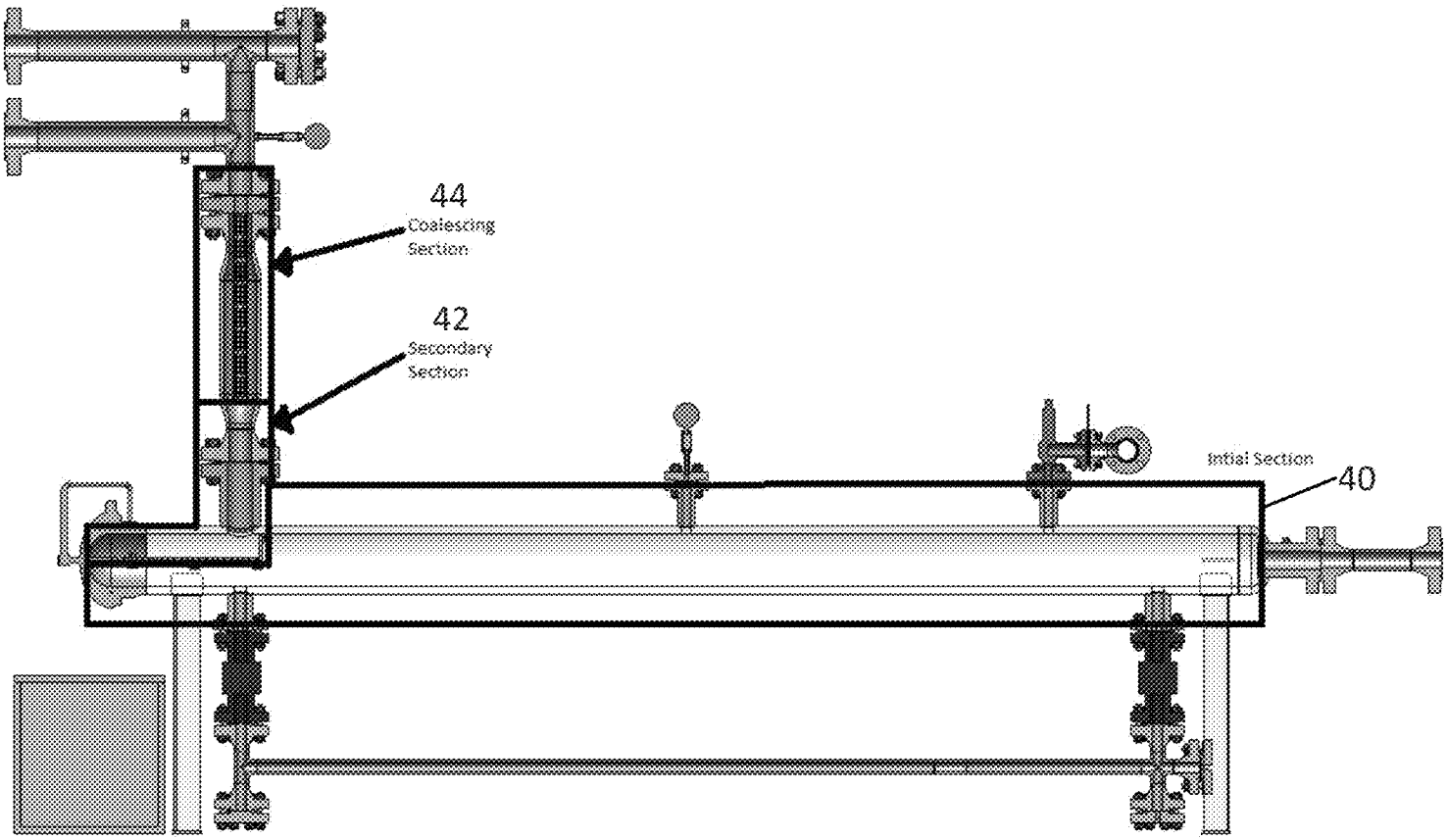
FIG. 4 is side view horizontal/vertical sand filter apparatus illustrating three stages/steps of filtration.

FIG. 4 is side view of the horizontal/vertical sand filter apparatus illustrating three stages/steps of filtration (described above), as follows: initial section/stage 40, secondary section/stage 42 and coalescing section/stage 44.

FIG. 5 is a side plan view of the area in which the initial section or step one 40 is performed. Inlet 12 provides an entry point to pressure vessel/velocity slowdown chamber 14 (also referred to interchangeably herein as "horizontally disposed gravity knock-out tube"). Outlet port 43 provides one means of egress for frac sand. Outlet port 48 provides a further means of egress for frac sand. Direction of flow of gas/liquid frac sand/solids from inlet 12 to port 46 is shown at 47. Just below nozzle 20, providing transition zone into the secondary stage of processing is port 46, which in situ is in operational engagement with nozzle 20.

FIG. 6 is a side view of a vertical screen/wire-wrapped slotted screen and gas flow diagram. Gas and remaining frac sand 50 from slowdown chamber 14 travels through nozzle 20 to cartridge 22 comprising wire wrapped screen 24. Frac sand stopped by wire wrapped screen 24. Clean gas 52 exits cartridge 22 at 52.

Figure 7:
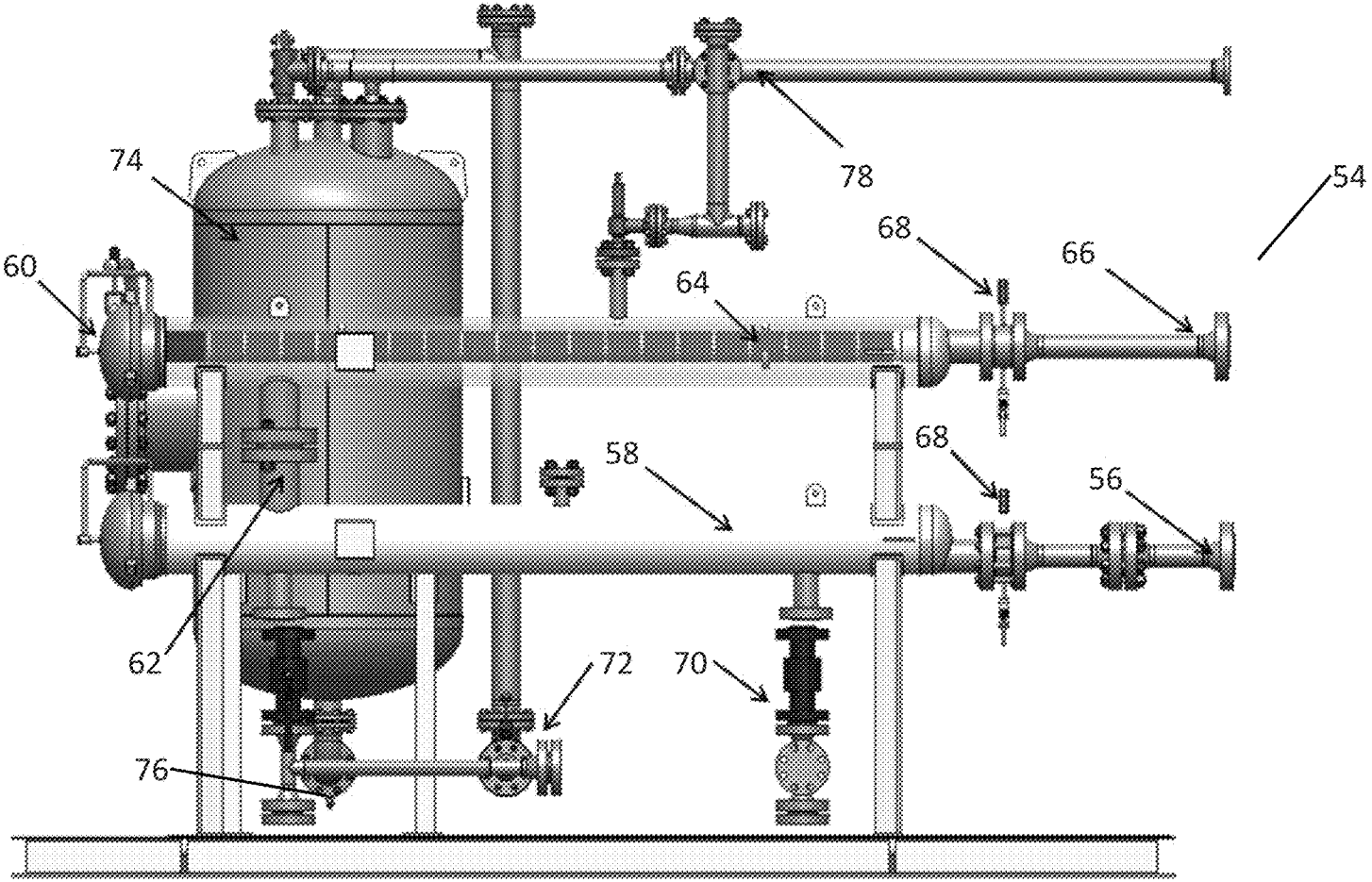
FIG. 7 is a side plan view of a horizontal/horizontal sand filter apparatus.
Figure 8:
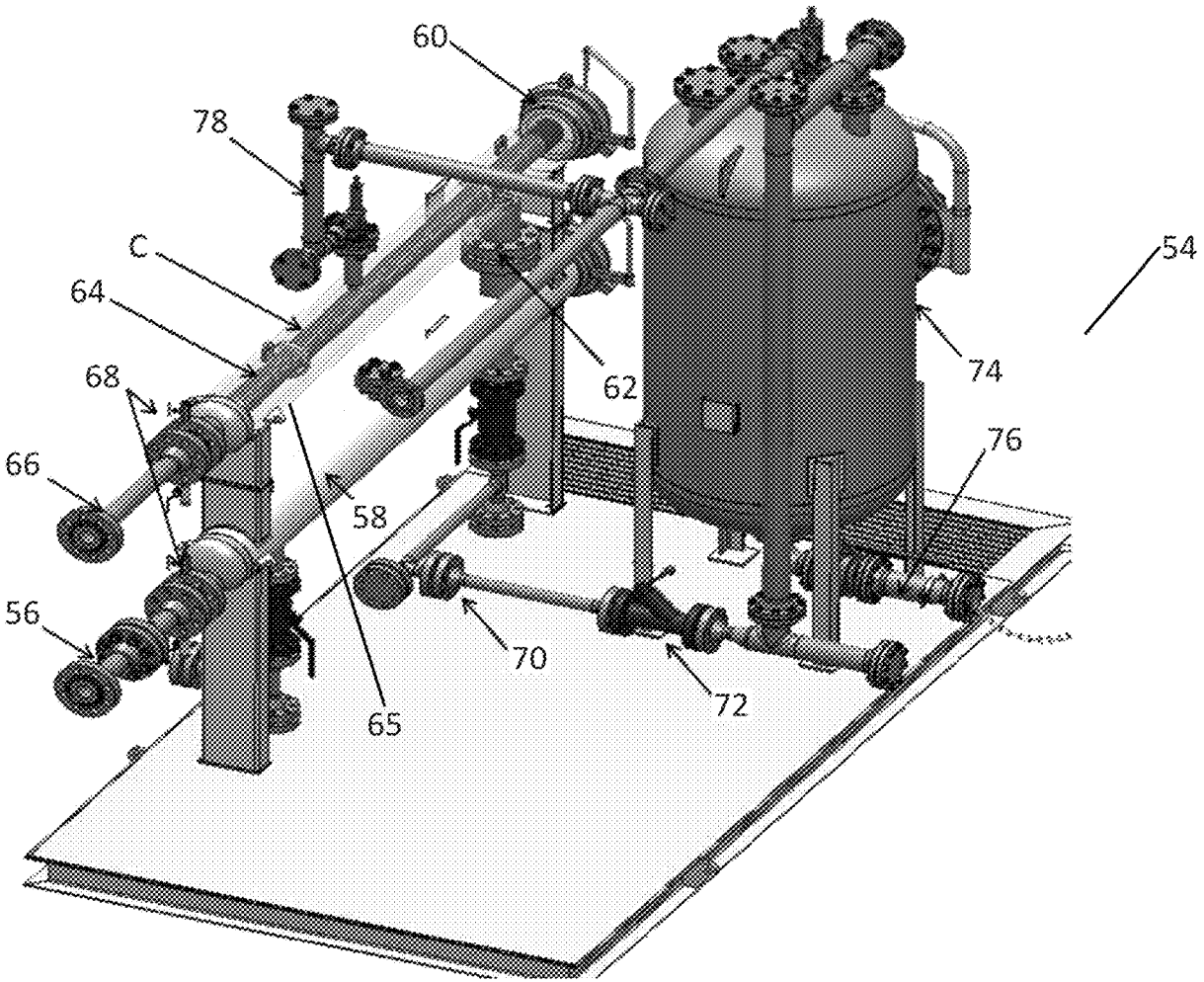
FIG. 8 is a perspective view of the horizontal/horizontal sand filter apparatus shown in FIG. 7.

FIG. 7 is a side plan view and FIG. 8 a perspective view of a horizontal/horizontal (H-H) sand filter apparatus shown generally at 54. In this H-H embodiment, an inlet is shown at 56, pressure vessel/velocity slowdown chamber (for primary processing) at 58, sand clean-out-screen access at 60, and nozzle/transition point from primary to secondary screening stages at 62. Horizontal screen 64 is disposed within cartridge 65 (within coalescing section 104) (see FIG. 10). Outlet or back flush is provided at 66. An upstream/downstream pressure indicator for auto/manual dump indication is provided at 68 and PSV line at 78.

In regards to blowdown, there is provided drain clean out channel 70, blowdown piping and valves 72, blowdown/sand storage chamber/vessel 74, and blowdown drain 76.

Figure 9:
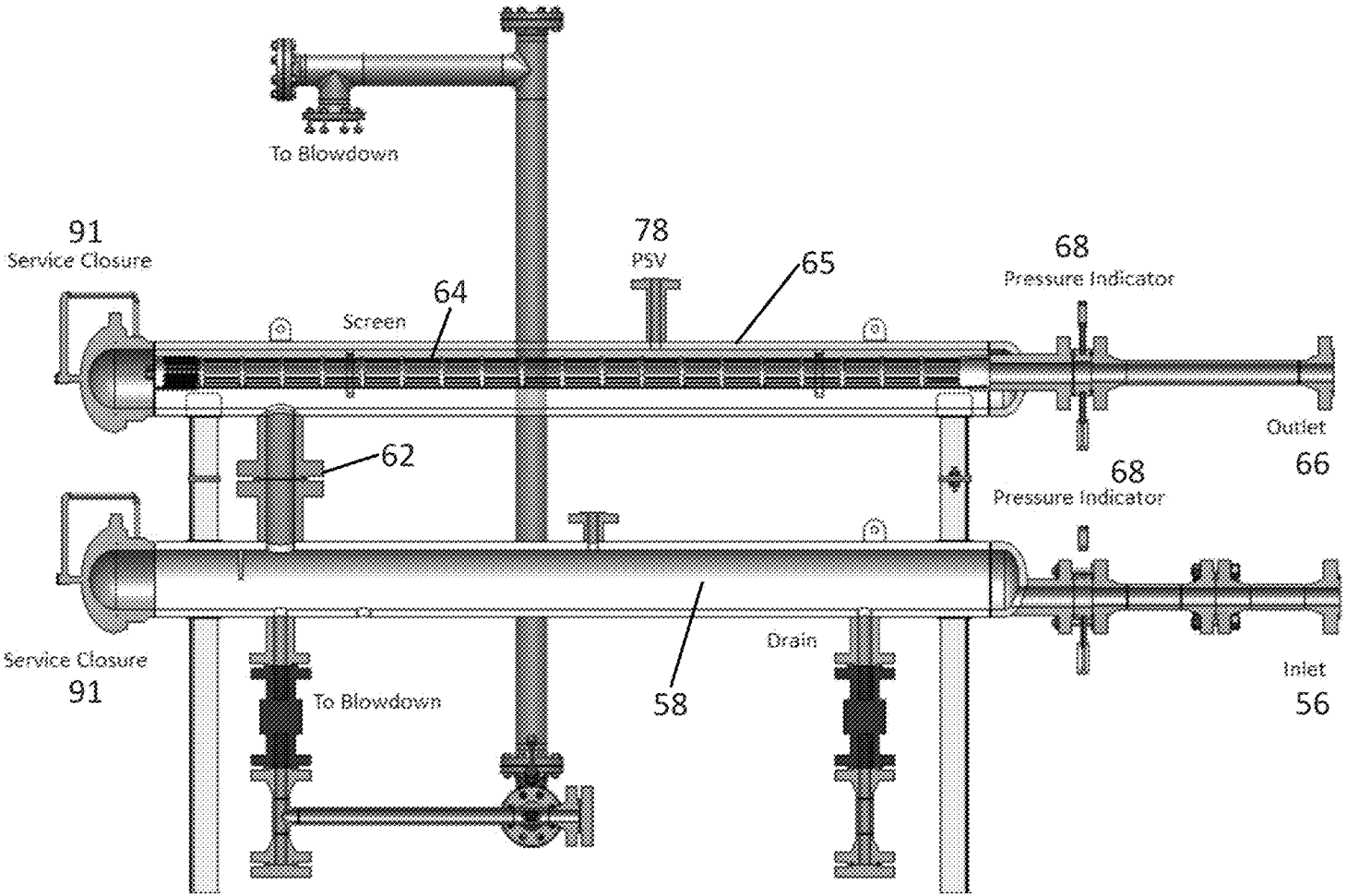
FIG. 9 is a side plan view of parts of a horizontal/horizontal sand filter apparatus.

FIG. 9 is a side plan view of parts of a horizontal/horizontal sand filter apparatus of FIGS. 7 and 8.

Figure 10:
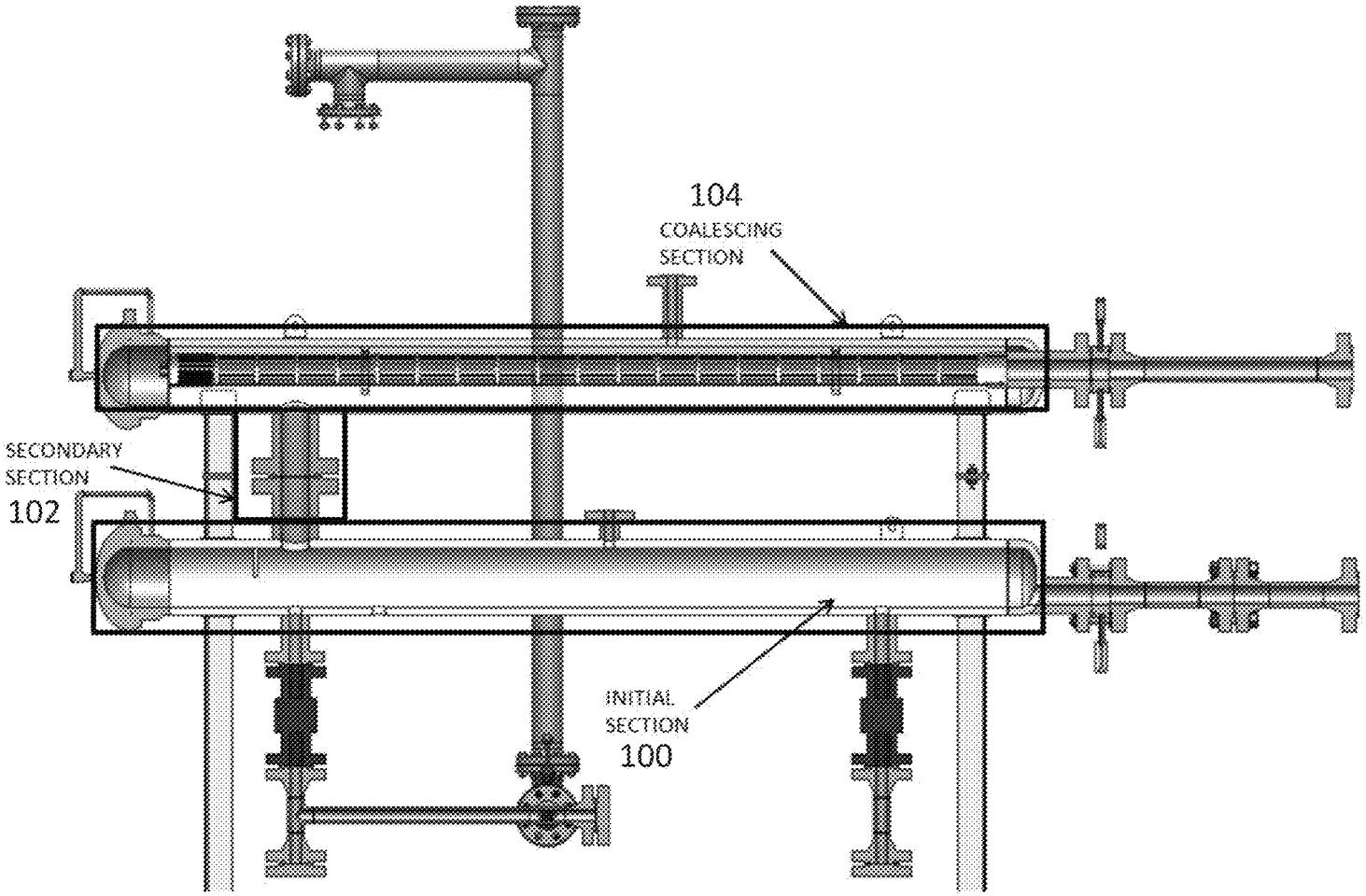
FIG. 10 is a side plan view of a horizontal/horizontal sand filter apparatus illustrating three stages/steps of filtration.

FIG. 10 is a side plan view of a horizontal/horizontal sand filter apparatus illustrating three stages/steps of filtration as follows: initial section/stage 100, secondary section/stage 102 and coalescing section/stage 104.

Figure 11:
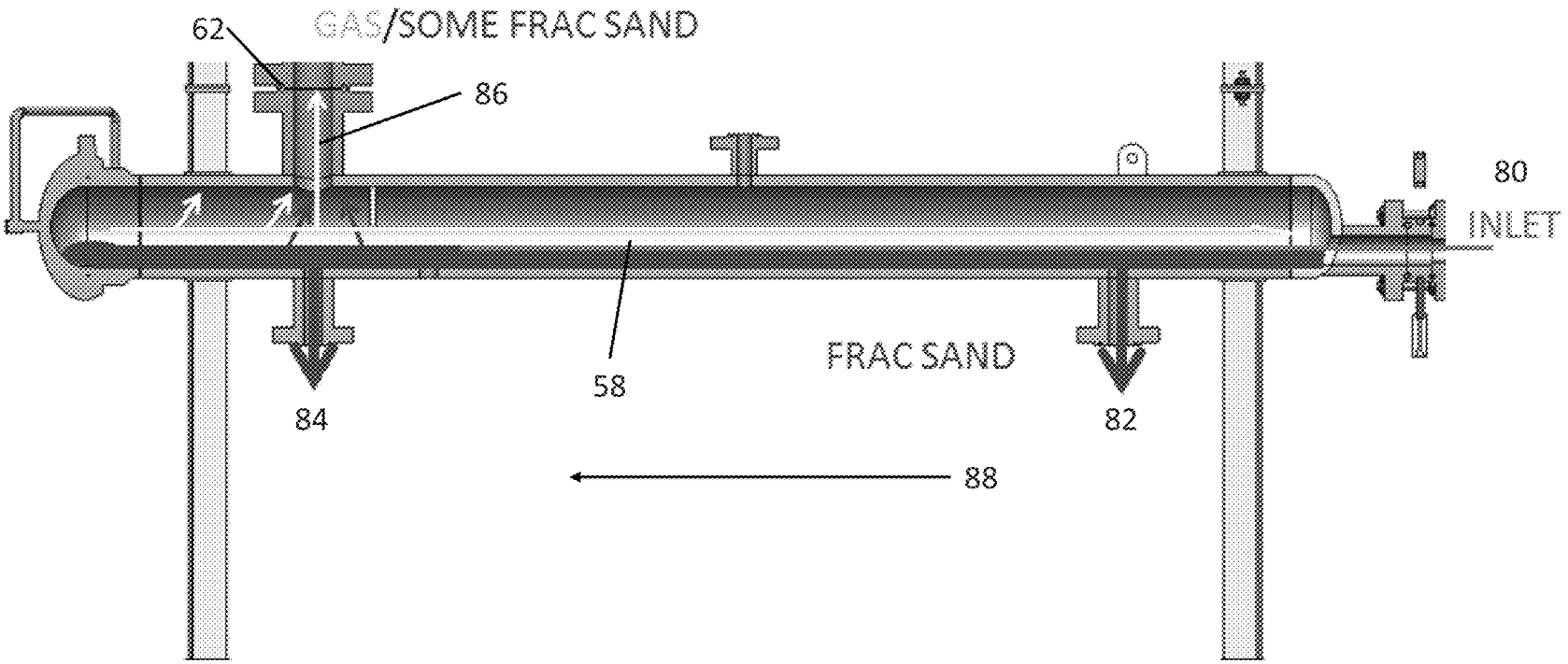
FIG. 11 is a side plan view of the "primary vessel" (area in which the initial section or step one is performed) namely sand accumulation and gas flow.

FIG. 11 is a side plan view of the "primary vessel" (area in which the initial section or step one is performed) namely sand accumulation and gas flow in which the initial section or step one 100 is performed. Inlet 80 provides an entry point to pressure vessel/velocity slowdown chamber 58 (also referred to interchangeably herein as "horizontally disposed gravity knock-out tube"). Outlet port 82 provides one means of egress for frac sand. Outlet port 84 provides a further means of egress for frac sand. Direction of flow of gas/liquid frac sand/solids from inlet 80 to port 86 is shown at 88. Just below nozzle 62, providing transition zone into the secondary stage of processing is port 86, which in situ is in operational engagement with nozzle 62.

Figure 12:
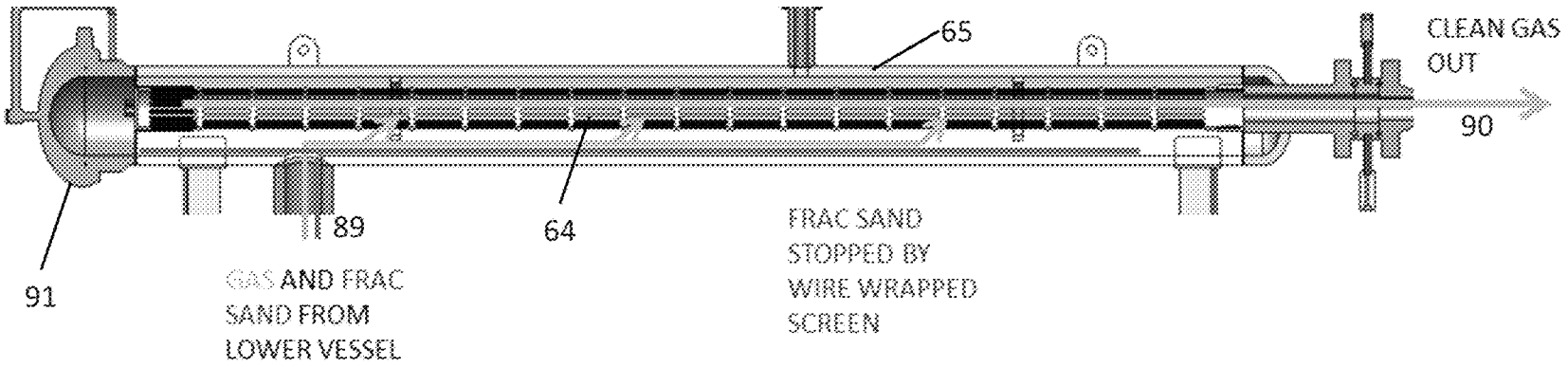
FIG. 12 is a side plan view of a sand filter/gas flow in horizontal screen chamber (comprising wire-wrapped slotted screen)

FIG. 12 is a side plan view of a sand filter/gas flow in horizontal screen chamber/cartridge 65 (comprising wire-wrapped slotted screen 64). Gas and remaining frac sand 89 from slowdown chamber 58 travels through nozzle 62 to cartridge 65 comprising wire wrapped screen 64. Frac sand is stopped by wire wrapped screen 64. Clean gas exits cartridge/chamber 65 at 90.

Figure 13:
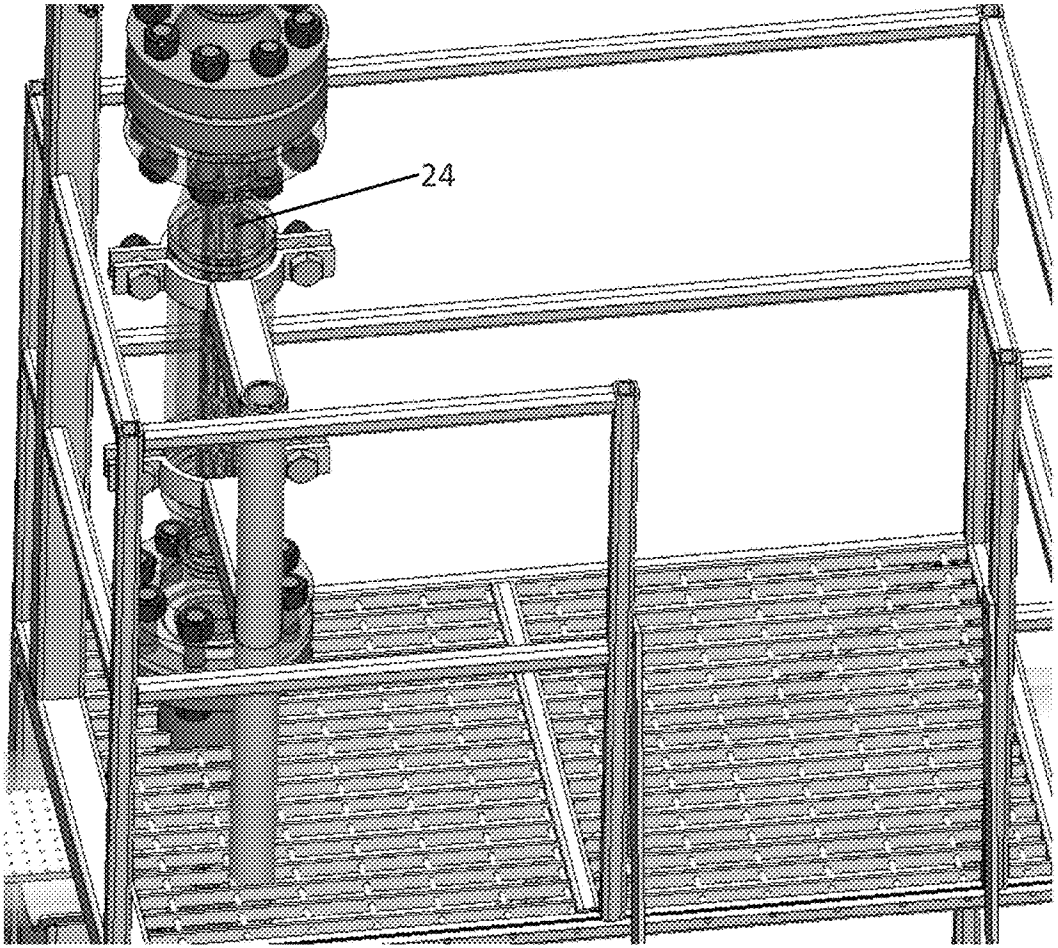

FIG. 13 is a perspective exploded view of vertically oriented tubular screen chamber 22 comprising a wire wrapped slotted screen 24 configured to filter out fine particulates and wherein wire wrapped slotted screen is housed within a removable cartridge wherein FIG. 13 illustrates removable cartridge in place.

Figure 14:
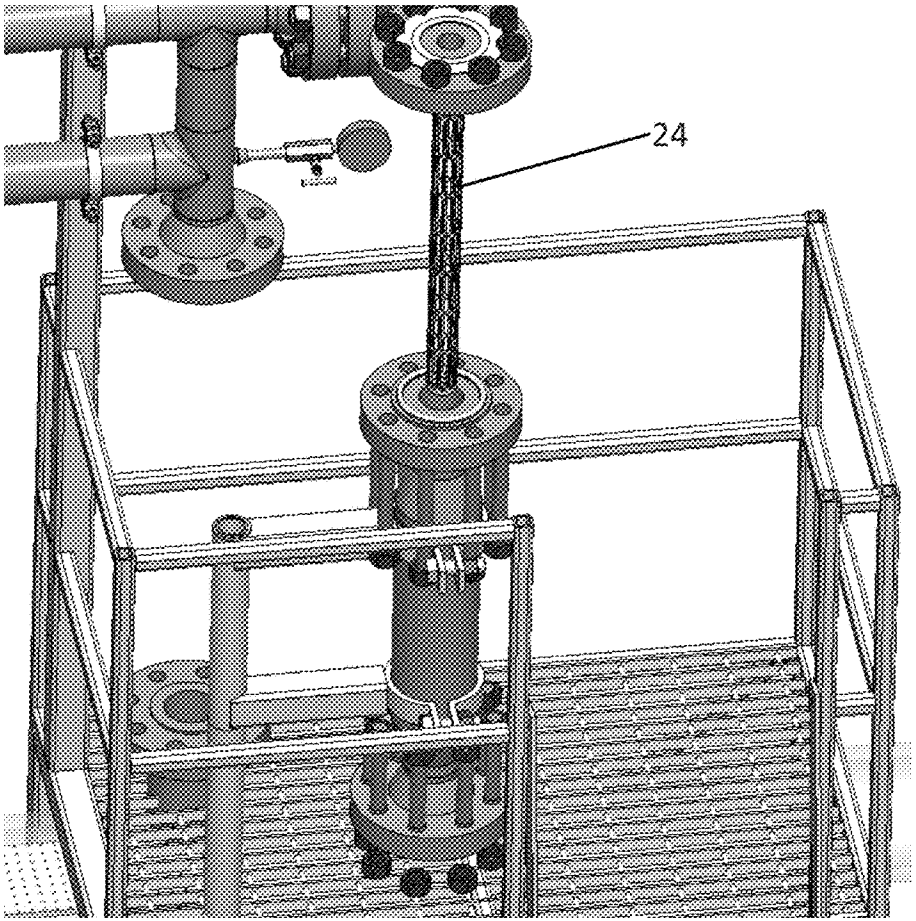

FIG. 14 is a perspective view of vertically oriented tubular screen chamber 22 comprising a wire wrapped slotted screen 24 configured to filter out fine particulates and wherein wire wrapped slotted screen is housed within a removable cartridge, wherein FIG. 14 illustrates removable cartridge with screen removed for cleaning/replacement.

Figure 15:
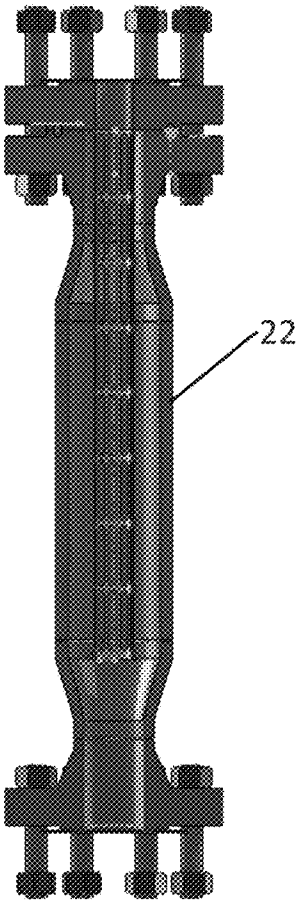
FIG. 15 is a side view of vertically oriented tubular screen chamber.

FIG. 15 is a side view of vertically oriented tubular screen chamber 22 with removable cartridge 24 in place.

Figure 16:
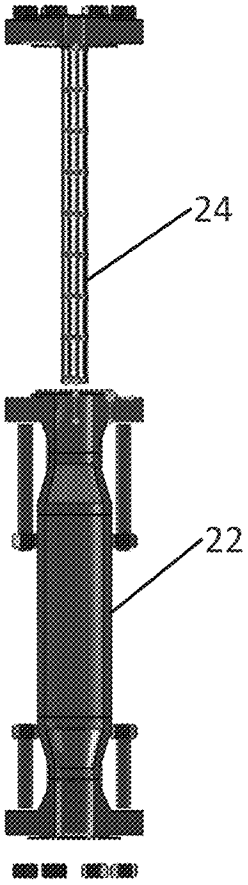
FIG. 16 is a further embodiment of vertically oriented tubular screen chamber.

FIG. 16 is a further embodiment of vertically oriented tubular screen chamber with removable cartridge with screen removed for cleaning/replacement.

Figure 17:
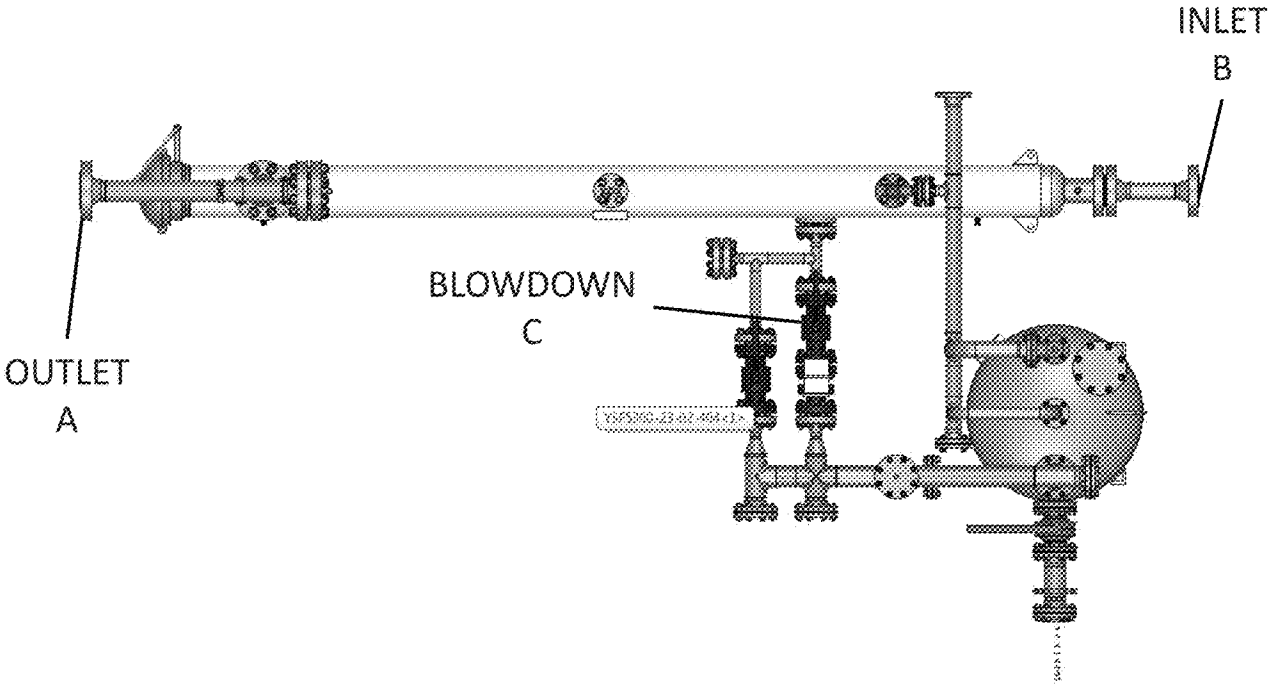
FIG. 17 is a side plan view of the orientation and operation of the blowdown valves.

FIG. 17 is a side plan view to assist in the understanding of the orientation and operation of the blowdown valves. There are a plurality of options for blowdown operation including two manual options and one automatic option:

Option 1 Manual

1. Close Valve A
2. Close Valve B
3. Open Valve C
4. Open Valve B
5. Open Valve C This is a highly effective and possibly the most effective blowdown means.

Option 2 Manual

1. Open Valve C
2. Close Valve C

Option 1 Automatic

1. At set differential pressure, Valve A shuts, delayed timer at Valve B shuts. Delayed timer at Valve C opens for a programmed period of time (for example 10 seconds).
2. Sequence in reverse order of step 1.
3. If pressure differential outside of set points, the process is repeated until clean out is completed.
4. If there is failure to clean after pre-determined number of attempts (for example three), an technician/operator is called for service.

Figure 18:
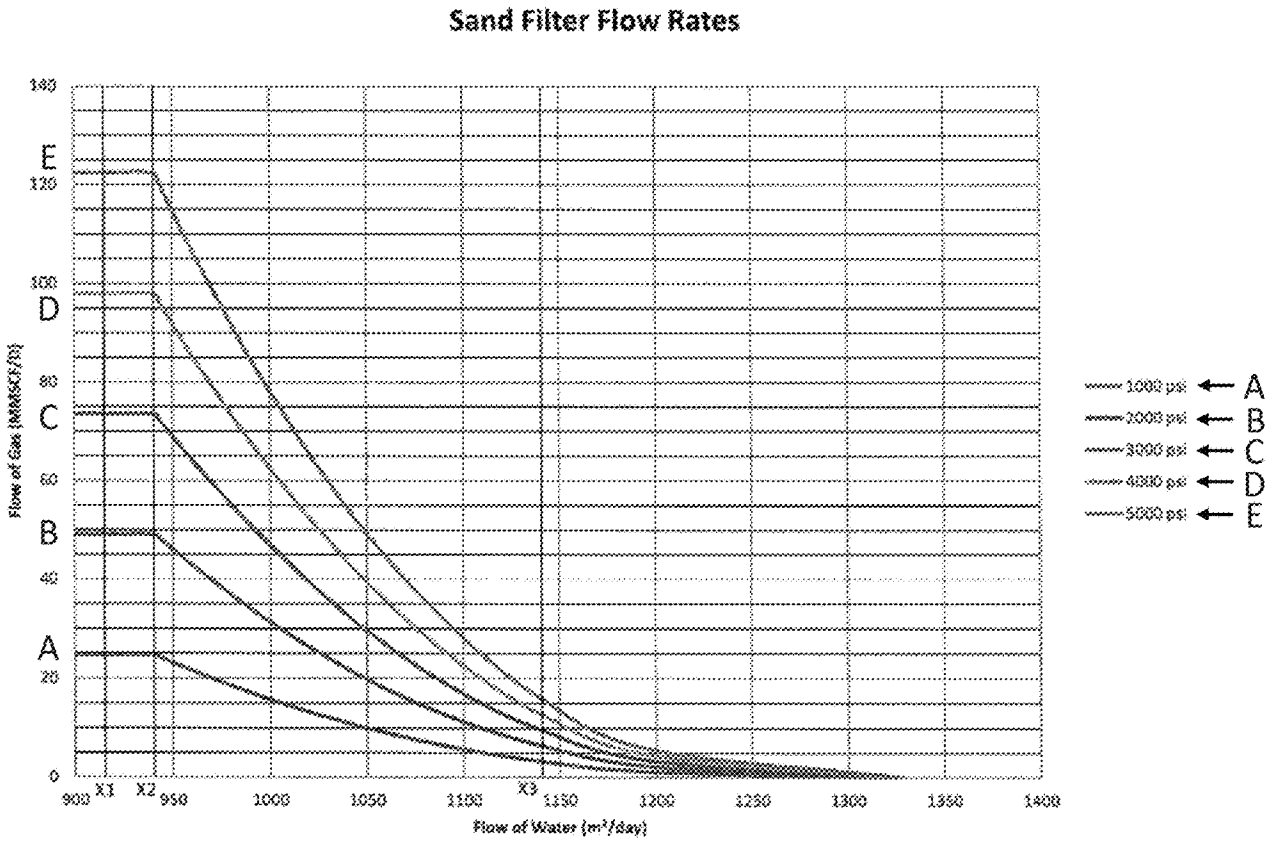
FIG. 18 is a graph showing sand filter flow rates.

Here is a brief explanation of the graph of FIG. 18: to the "left" X2 is shown the amount of liquids/water/oil which can flow through the screen before there is an impact to Gas flow. To the right of X2 is shown that increasing liquid flow will reduce the Flow Capacity of the Gas in the sand filter. The five lines indicate different operating pressures of gas entering the units, from 1000 psi to 5000 psi as follows:

A—1000 psi
B—2000 psi
C—3000 psi
D—4000 psi
E 5000 psi

As will be apparent to those skilled in the art, the various embodiments described above can be combined to provide further embodiments. Aspects of the present systems, methods and components can be modified, if necessary, to employ systems, methods, components and concepts to provide yet further embodiments of the invention. For example, the various devices and methods described above may omit some parts or acts, include other parts or acts, and/or execute acts in a different order than set out in the illustrated embodiments.

Further, in the methods taught herein, the various acts may be performed in a different order than that illustrated and described. Additionally, the methods can omit some acts, and/or employ additional acts.

These and other changes can be made to the articles in light of the above description. In general, in the following claims, the terms used should not be construed to limit the invention to the specific embodiments disclosed in the specification and the claims, but should be construed to include all possible embodiments along with the full scope of equivalents to which such claims are entitled. Accordingly, the invention is not limited by the disclosure, but instead its scope is to be determined entirely by the following claims.

FIGS. 19A-19H provide an example of flow rate calculations.

What is claimed:

1. A filtering apparatus for separating solids from a hydrocarbon fluid comprising:

(a) a pressure vessel having a velocity slow down chamber having an inlet and outlet communicating with said velocity slow down chamber;

said velocity slow down chamber is horizontally disposed;

said velocity slow down chamber being of a size and configuration such that, in operation, gravitational force on particles of the solids substantially exceeds any drag created by flow of said hydrocarbon fluid, thereby to induce gravity settling of at least a portion of the solids at a bottom of said velocity slow down chamber as settled solids, said settled solids, in situ, serving to increased differential pressure from the inlet to an outlet; and said outlet disposed at a second end of the velocity slow down chamber, opposing a first end of the velocity slow down chamber and in fluid communication with at least one of i) a vertically oriented tubular screen chamber and ii) a horizontally oriented tubular screen chamber, wherein the vertically oriented tubular screen chamber and the horizontally oriented tubular screen chamber are elevated relative to the horizontally disposed velocity slow down chamber to prevent/reduce solids from accumulating around the tubular screen chambers (b) said inlet adapted to receive said solids and hydrocarbon fluid to said velocity slow down chamber so as to settle at least a portion of said solids at a bottom of said pressure vessel from said hydrocarbon fluid with a remaining portion of said solids;

(c) an elevated chamber elevated relative to said pressure vessel communicating with said outlet so as to receive said hydrocarbon fluid with the remaining portion of said solids; and (d) a slotted screen disposed in said elevated chamber to filter out another portion of said remaining portion of said solids from said hydrocarbon fluid.

2. The filtering apparatus of claim 1, comprising a plurality of drain valves.

3. The filtering apparatus of claim 1, wherein the inlet is positioned at an upper end of the horizontally disposed velocity slow down chamber.

4. A method of cleaning the sand filtering apparatus of claim 1, wherein the method comprises:

a) closing an inlet valve associated with said inlet and closing an outlet valve associated with said outlet to trap pressure in said horizontally disposed velocity slow down chamber; and b) opening at least one drain valve to blow out said settled solids from said tube to a collection tank/blowdown vessel.

5. The filtering apparatus of claim 1, wherein the solids are sand.

6. The filtering apparatus as claimed in claim 1, further including a perforated plate disposed between the outlet and the elevated chamber.

7. The filtering apparatus as claimed in claim 6, wherein said elevated chamber comprises at least one of:

(a) a vertically orientated chamber; and (b) a horizontally orientated chamber, wherein the vertically orientated chamber and horizontally orientated chamber are elevated relative to the pressure vessel to reduce solids from accumulating around the elevated chamber.

8. The filtering apparatus as claimed in claim 7, wherein said slotted screen comprises a wire wrapped slotted screen housed within a removable cartridge.

9. The filtering apparatus as claimed in claim 1, wherein the vertically oriented tubular screen chamber and the horizontally oriented tubular screen chamber require a wire wrapped slotted screen configured to filter out fine particulates and wherein the wire wrapped slotted screen is housed within a removable cartridge.

10. The filtering apparatus of claim 9, wherein the cartridge is removably engaged to egress piping downstream of the tubular screen chambers for easy removal when replacing the screen.

11. The filtering apparatus of claim 9, wherein a wire of the wire wrapped slotted screen is V-shaped.

12. The apparatus of claim 11, wherein the wire is spaced to define a wire slot size so as to filter different sizes of the particulates.

13. The apparatus of claim 12, wherein the wire is sized so as to filter different sizes of the particulates.

14. The filtering apparatus as claimed in claim 1, further including a perforated plate for secondary filtering disposed between the outlet and the vertically oriented tubular screen chamber or the horizontally oriented tubular screen chamber.

15. A method for separating sand or other solids from oil or other fluids that are produced from a well, the method comprising:

a) introducing a fluid containing solids into an inlet of a horizontally disposed gravity knock-out tube, wherein the fluid is introduced into the horizontally disposed gravity knock-out tube at a rate and direction such that a gravitational force on particles of the sand or other solids substantially exceeds any drag created by flow of said fluid, thereby to induce gravity settling of at least a portion of the solid at a bottom of the tube as settled solids, said settled solids, in situ, serving to increase differential pressure from the inlet to an outlet and therein forming a primary treated fluid; and b) passing said primary treated fluid to a horizontally oriented tubular screen chamber via a perforated plate, wherein the horizontally oriented tubular screen chamber is elevated relative to the horizontally disposed gravity knock-out tube to prevent/reduce solids from accumulating around the horizontally orientated tubular screen chamber, wherein the horizontally oriented tubular screen chamber comprises a wire wrapped slotted screen configured to filter out fine particulates and wherein wire wrapped slotted screen is housed within a removable cartridge.

16. The method of claim 15, wherein the fluid is hydrocarbon.

* * * * *